US010186842B2

(12) United States Patent
Rozman

(10) Patent No.: US 10,186,842 B2
(45) Date of Patent: Jan. 22, 2019

(54) GAS DISCHARGE TUBES AND METHODS AND ELECTRICAL SYSTEMS INCLUDING SAME

(71) Applicant: RIPD IP DEVELOPMENT LTD, Nicosia (CY)

(72) Inventor: Robert Rozman, Smlednik (SI)

(73) Assignee: RIPD IP DEVELOPMENT LTD, Nicosia (CY)

( * ) Notice: Subject to any disclaimer, the term of this patent is extended or adjusted under 35 U.S.C. 154(b) by 271 days.

(21) Appl. No.: 15/089,294

(22) Filed: Apr. 1, 2016

(65) Prior Publication Data

US 2017/0288371 A1 Oct. 5, 2017

(51) Int. Cl.
*H01T 4/08* (2006.01)
*H01T 2/02* (2006.01)
*H01T 4/16* (2006.01)

(52) U.S. Cl.
CPC ..... *H01T 4/08* (2013.01); *H01T 2/02* (2013.01); *H01T 4/16* (2013.01)

(58) Field of Classification Search
CPC .... H01T 4/04; H01T 4/06; H01T 4/08; H01T 4/12; H01T 4/16; H01T 4/20
See application file for complete search history.

(56) References Cited

U.S. PATENT DOCUMENTS 2,326,074 A 8/1943 Slepian
2,365,518 A * 12/1944 Berkey ..... H01T 4/12 220/2.3 R
2,562,692 A 7/1951 Bigwood
4,190,733 A 2/1980 Wootton
4,491,893 A 1/1985 Toda
7,053,536 B1 5/2006 Boman et al.
7,570,473 B2 * 8/2009 Adachi ..... H01T 4/10 361/117
7,604,754 B2 * 10/2009 Summers ..... C08G 59/245 106/1.05
7,643,265 B2 1/2010 Loader et al.
7,660,095 B2 2/2010 Shato et al.
7,719,815 B2 5/2010 Shato et al.
7,937,825 B2 5/2011 Shato et al.
2014/0092514 A1 4/2014 Chen

FOREIGN PATENT DOCUMENTS

DE 29724817 U1 * 4/2004 ..... H01T 4/16
DE 102011102864 A1 4/2012
EP 0905840 A1 3/1999
(Continued)

OTHER PUBLICATIONS

"Gas Discharge Tubes—GDT", Iskra Zaščite, Jul. 4, 2014, 2 pages.
(Continued)

*Primary Examiner* — Scott Bauer
(74) *Attorney, Agent, or Firm* — Myers Bigel, P.A.

(57) ABSTRACT

A gas discharge tube includes a housing defining a chamber, first and second terminal electrodes mounted on the housing, a plurality of inner electrodes located in the chamber, and a gas contained in the chamber. The inner electrodes are serially disposed in the chamber in spaced apart relation to define a series of spark gaps from the first terminal electrode to the second terminal electrode. The chamber is hermetically sealed.

31 Claims, 33 Drawing Sheets

(56) References Cited

FOREIGN PATENT DOCUMENTS

| | | | | | |
|---|---|---|---|---|---|
| EP | 1075064 | A1 | | 2/2001 | |
| EP | 2573885 | A1 | | 3/2013 | |
| FR | 2451628 | A1 | | 10/1980 | |
| FR | 2991117 | B3 | * | 12/2014 | ..... H01T 4/16 |
| GB | 352756 | | | 7/1931 | |
| WO | WO 2010/086286 | A1 | | 8/2010 | |
| WO | WO 2017129291 | A1 | * | 8/2017 | ..... H01T 4/16 |

OTHER PUBLICATIONS

Translation of DIN-Standards, Built-In Equipment for Electrical Installations; Overall Dimensions and Related Mounting Dimensions, Dec. 1988, 15 pages.

Wikipedia, the free encyclopedia, "Gas-filled tube", Retrieved on: Jan. 20, 2015, 9 pages. Retrieved from: http://en.wikipedia.org/wiki/Gas-filled_tube.

Extended European Search Report Corresponding to European Application No. 17162088.3; dated Aug. 28, 2017; 9 Pages.

* cited by examiner

GAS DISCHARGE TUBES AND METHODS AND ELECTRICAL SYSTEMS INCLUDING SAME

FIELD OF THE INVENTION

The present invention relates to circuit protection devices and, more particularly, to overvoltage protection devices and methods.

BACKGROUND

Frequently, excessive voltage or current is applied across service lines that deliver power to residences and commercial and institutional facilities. Such excess voltage or current spikes (transient overvoltages and surge currents) may result from lightning strikes, for example. The above events may be of particular concern in telecommunications distribution centers, hospitals and other facilities where equipment damage caused by overvoltages and/or current surges and resulting down time may be very costly.

SUMMARY

According to embodiments of the invention, a gas discharge tube includes a housing defining a chamber, first and second terminal electrodes mounted on the housing, a plurality of inner electrodes located in the chamber, and a gas contained in the chamber. The inner electrodes are serially disposed in the chamber in spaced apart relation to define a series of spark gaps from the first terminal electrode to the second terminal electrode. The chamber is hermetically sealed.

In some embodiments, the plurality of electrodes includes at least three inner electrodes defining at least four inner spark gaps.

In some embodiments, the housing includes an insulator and a cover forming the housing and defining the chamber, and the insulator is formed of an electrically insulating material. The cover may be electrically conductive.

According to some embodiments, at least some of the inner electrodes are curved plates.

In some embodiments, the inner electrodes are captured in the chamber to permit limited displacement between the housing and the inner electrodes.

The gas discharge tube may further include a trigger device that is contained in the housing and that is electrically conductively coupled to either one of the first terminal electrode or the second terminal electrode and to ones of the plurality of inner electrodes.

In some embodiments, the trigger device is disposed in the chamber.

According to some embodiments, the trigger device includes: a substrate formed of an electrically insulating material; and a plurality of resistor links mounted on the substrate, wherein the resistor links are configured to conduct current from the inner electrodes.

In some embodiments, the trigger device includes holes defined in the substrate to permit electrical connection between the resistor links and the inner electrodes.

According to some embodiments, each of the resistor links includes a resistor layer bonded to the substrate, the resistor layer being formed of an electrically resistive material. The electrically resistive material may include graphite in an adhesive carrier. In some embodiments, each of the resistor links further includes a terminal interface layer between the resistor layer thereof and the inner electrode associated with the resistor link, and the terminal interface layer is formed of metal.

According to some embodiments, each of the resistor links has a resistance value in the range of from about 3 to 500 ohm.

The trigger device may include integral locator features that secure the inner electrodes in position in the chamber.

The housing may include integral locator features that secure the inner electrodes in position in the chamber.

In some embodiments, the housing includes a partition wall that divides the chamber into fluidly connected first and second subchambers, the first terminal electrode is disposed in the first subchamber, the second terminal electrode is disposed in the second subchamber; and some of the inner electrodes are disposed in the first subchamber and some of the inner electrodes are disposed in the second subchamber.

In some embodiments, the inner electrodes are concentric, cylindrically-shaped plates, and the second terminal includes an annular wall concentric with and circumferentially surrounding the inner electrodes.

In some embodiments, the trigger device includes first and second substrates each formed of an electrically insulating material, at least one resistor link mounted on the first substrate, and at least one resistor link mounted on the second substrate. The resistor links are configured to conduct current from the inner electrodes. In some embodiments, the second substrate is stacked on the first substrate.

In some embodiments, the gas contained in the chamber comprises helium. In some embodiments, the helium gas is present in the chamber in an amount of at least 50% by volume of the total volume of gas in the chamber. In some embodiments, the gas contained in the chamber comprises a mixture of helium and at least one other gas.

According to method embodiments of the invention, a method includes: electrically conductively coupling a first terminal electrode to a phase line of a power system and a second terminal electrode to a neutral line of a power system; providing a plurality of inner electrodes that are arranged between first terminal electrode and the second terminal electrode and that are spaced apart from one another; and electrically conductively coupling a plurality of resistors between respective ones of the plurality of inner electrodes and the second terminal electrode.

In some embodiments, the providing the plurality of inner electrodes comprises arranging the plurality of inner electrodes to define a plurality of spark gaps between the first electrode and a first one of the plurality of the inner electrodes, between ones of the plurality of inner electrodes and between a second one of the plurality of inner electrodes and the second terminal.

According to some embodiments, responsive to a system operating voltage being present on the phase line, no current flows between the first terminal electrode and the second terminal, and responsive to an overvoltage condition being present on the phase line, a current flows from the first terminal electrode to the second terminal electrode. In some embodiments, the current that flows from the first terminal electrode to the second terminal electrode flows across the plurality of spark gaps.

The method may further include providing a housing that defines a chamber, wherein the first terminal electrode and the second terminal electrode are mounted on the housing, wherein the plurality of inner electrodes are located in the chamber, and wherein the plurality of resistors are located in the chamber.

According to embodiments of the technology, an overvoltage protection circuit includes at least one housing defining at least one hermetically sealed chamber, and a series of spaced apart electrodes defining a series of spark gaps therebetween located in the at least one chamber. A gas is contained in the at least one chamber. The gas contained in the at least one chamber includes helium.

It is noted that aspects of the invention described with respect to one embodiment, may be incorporated in a different embodiment although not specifically described relative thereto. That is, all embodiments and/or features of any embodiment can be combined in any way and/or combination. These and other objects and/or aspects of the present invention are explained in detail in the specification set forth below.

BRIEF DESCRIPTION OF THE DRAWINGS

The accompanying figures are included to provide a further understanding of the present invention, and are incorporated in and constitute a part of this specification. The drawings illustrate some embodiments of the present invention and, together with the description, serve to explain principles of the present invention.

DETAILED DESCRIPTION OF EMBODIMENTS OF THE INVENTION

Figure 1:
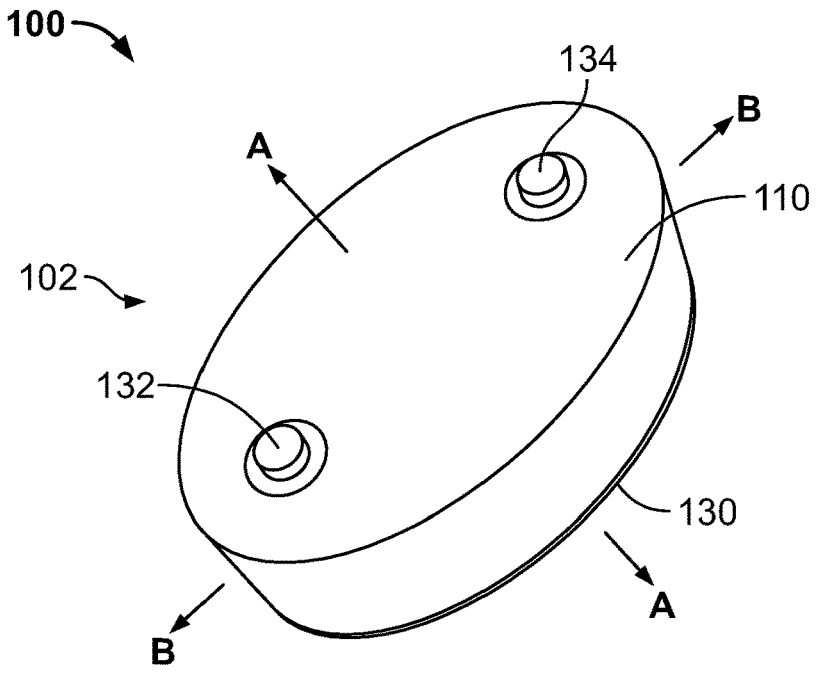
FIG. 1 is a bottom perspective view of a gas discharge tube (GDT) according to some embodiments of the invention.
Figure 2:
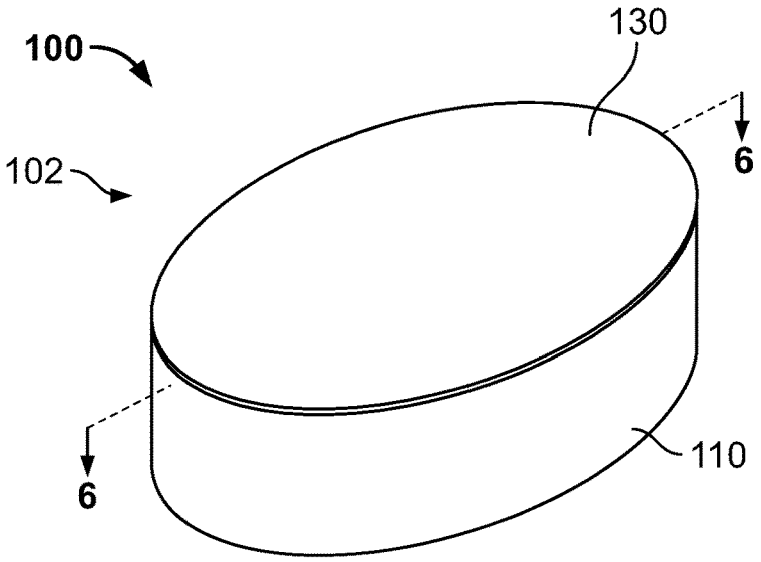
FIG. 2 is a top perspective view of the GDT of FIG. 1.
Figure 3:
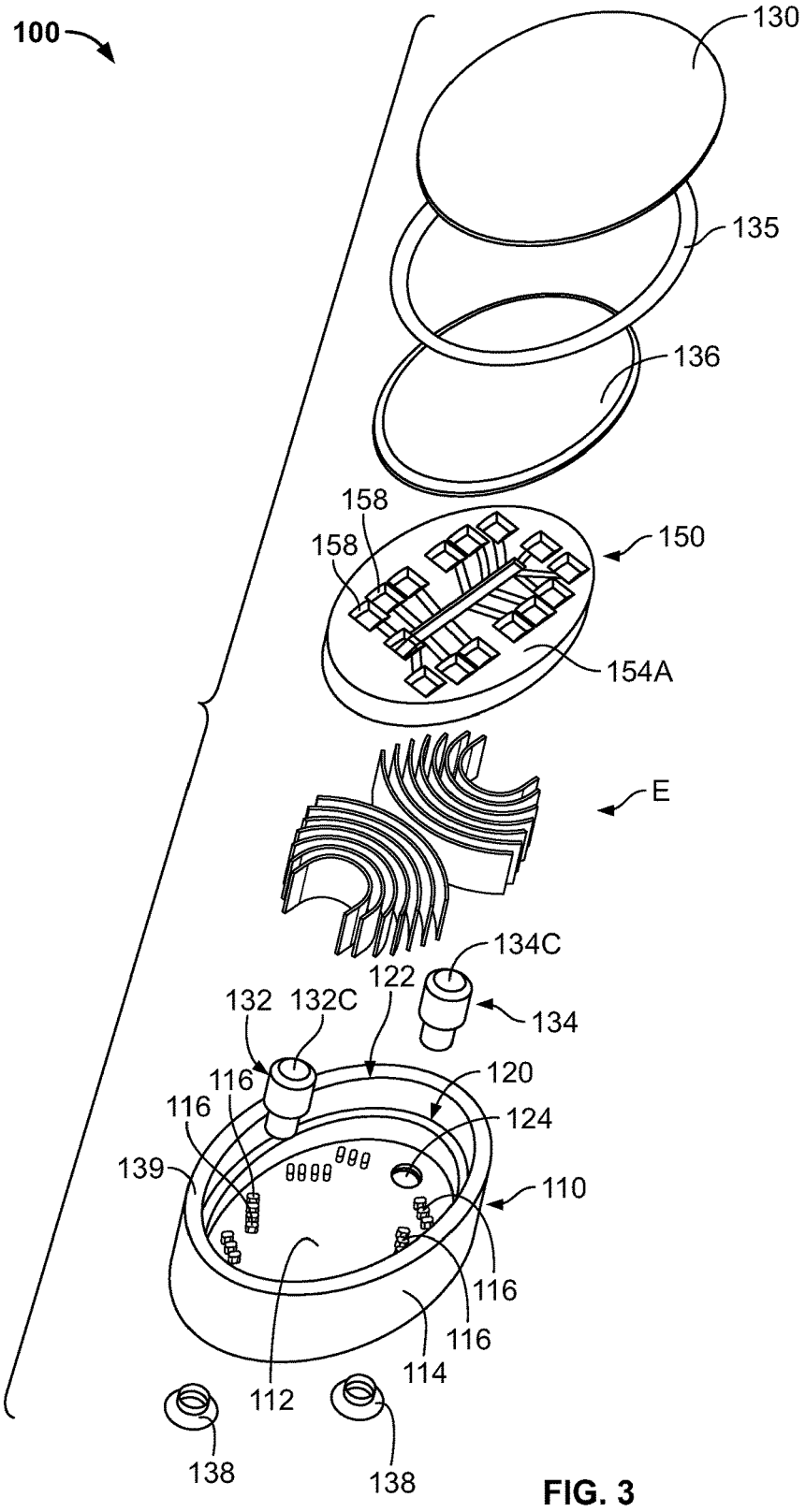
FIG. 3 is an exploded, top perspective view of the GDT of FIG. 1.
Figure 4:
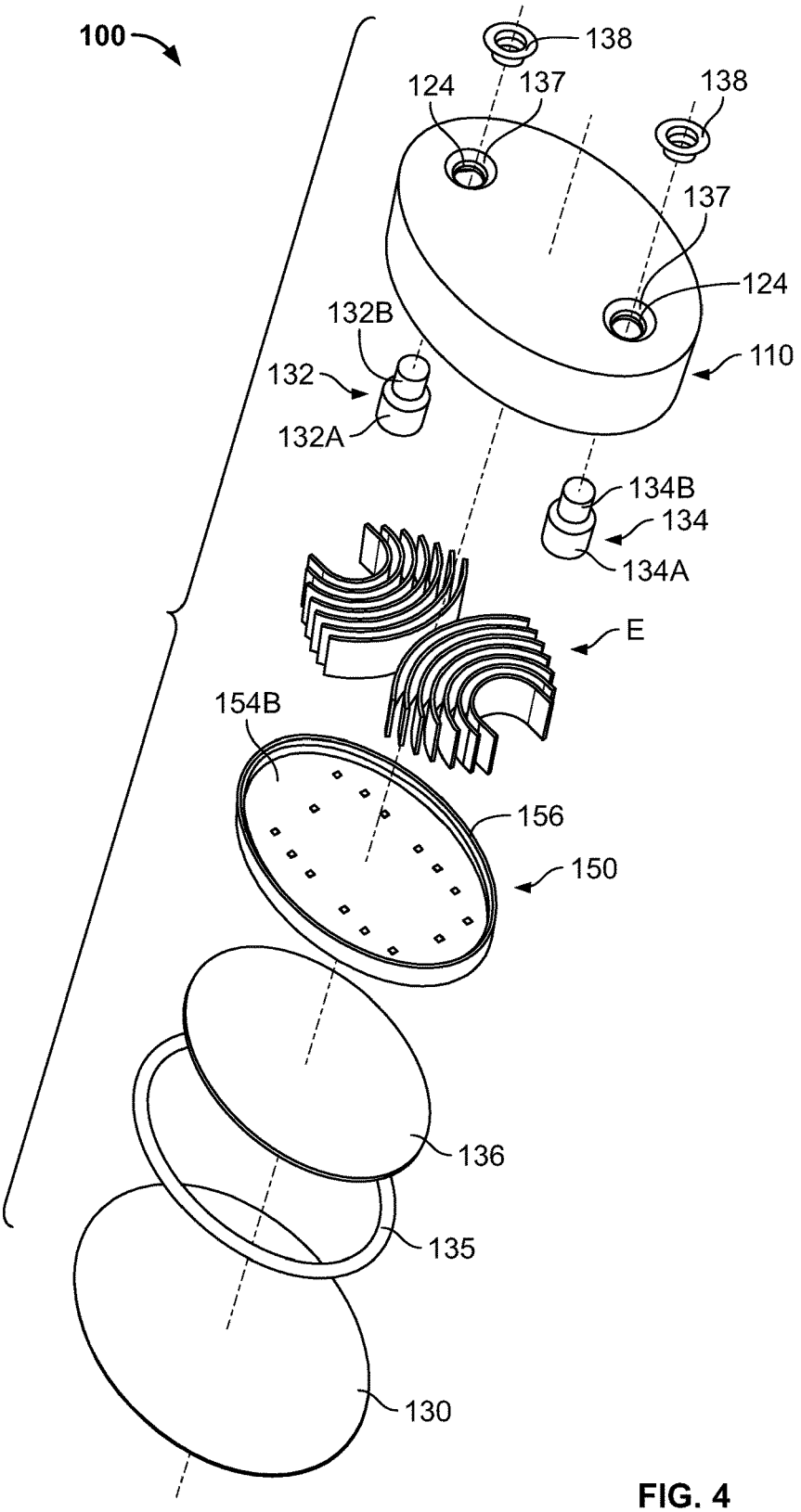
FIG. 4 is an exploded, bottom perspective view of the GDT of FIG. 1.
Figure 5:
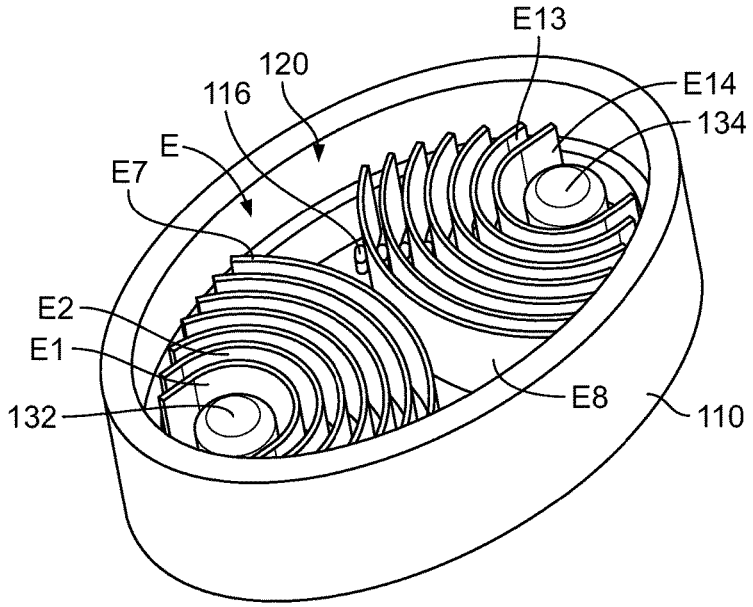
FIG. 5 is a fragmentary top perspective view of the GDT of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, a "hermetic seal" is a seal that prevents the passage, escape or intrusion of air or other gas through the seal (i.e., airtight). "Hermetically sealed" means that the described void or structure (e.g., chamber) is sealed to prevent the passage, escape or intrusion of air or other gas into or out of the void or structure.

As used herein, "monolithic" means an object that is a single, unitary piece formed or composed of a material without joints or seams.

Figure 6:
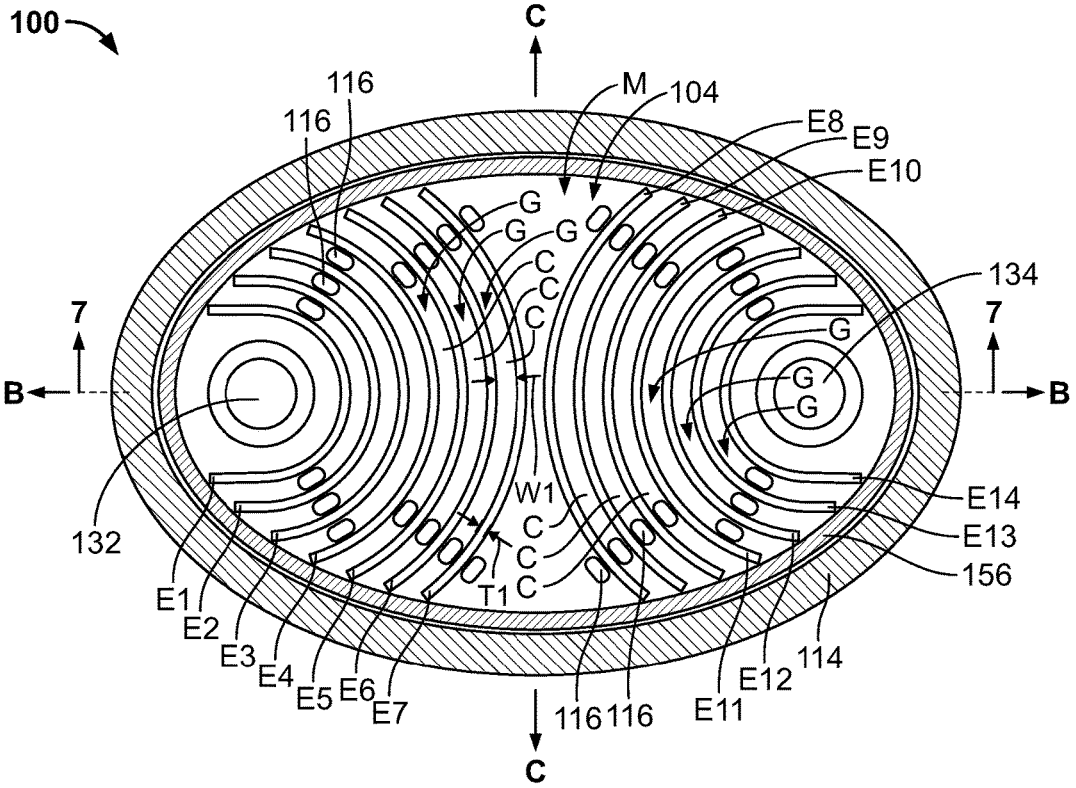
FIG. 6 is cross-sectional view of the GDT of FIG. 1 taken along the line 6-6 of FIG. 2.

With reference to FIGS. 1-11, a modular, multi-cell gas discharge tube (GDT) 100 according to embodiments of the invention is shown therein. The GDT 100 includes an insulator 110, a cover 130, a first terminal electrode 132, a second terminal electrode 134, a set E of inner electrodes E1-E14, an insulator 136, seals 135, 138, bonding layers 137, 139, a trigger device 150, and a selected gas M (FIG. 6).

The insulator 110 and the cover 130 collectively form an enclosure or housing 102 defining an enclosed GDT chamber 104 (FIG. 6). The terminal electrodes 132, 134, the inner electrodes E1-E14, the insulator plate 136, the trigger device 150, and the gas M are contained in the chamber 104. The housing 102 has a central axis A-A (FIG. 1), a first lateral axis B-B, and a second lateral axis C-C (FIG. 6). As discussed hereinbelow, the sixteen electrodes 132, 134, E1-E14 define a plurality of gaps G (fifteen gaps G) and a plurality of cells C (fifteen cells C) between the electrodes 132, 134, E1-E14 (FIG. 6). The electrodes 132, 134 E1-E14 and the gaps G and cells C are serially distributed in spaced apart relation along the axis B-B.

The insulator 110 may be generally cup-shaped. The insulator 110 includes an end or bottom wall 112 and an annular, elliptical, upstanding side wall 114 collectively defining a cavity 120 and a top opening 122 communicating with the cavity 120. Electrode through holes or openings 124 extend through the bottom wall 112. Integral locator features or tabs 116 project upwardly from the bottom wall 112. The insulator 110, the cavity 120 and the chamber 104 are elliptically shaped in cross-section perpendicular to the axis A-A.

The insulator 110 may be formed of any suitable electrically insulating material. According to some embodiments, the insulator 110 is formed of a material having a melting temperature of at least 1000 degrees Celsius and, in some embodiments, at least 1600 degrees Celsius. In some embodiments, the insulator 110 is formed of a ceramic. In some embodiments, the insulator 110 includes or is formed of alumina ceramic ($Al_2O_3$) and, in some embodiments, at least about 90% $Al_2O_3$. In some embodiments, the insulator 110 is monolithic.

The electrodes 132, 134 each include a head 132A, 134A disposed in the cavity 120 and a contact post 132B, 134B extending through a respective opening 124 and projecting outwardly from the insulator 110. A bonding layer 137 is interposed between each post 132B, 134B and the inner surface of its opening 124. The posts 132B, 134B are bonded to the insulator 110 by the bonding layers 137 continuously about the full peripheries of the openings 124. The bonding layers 137 along with the seals 138 hermetically seal the openings 124. In some embodiments, the bonding layers 137 are metallization, solder or metal-based layers. Suitable metal-based materials for forming the bonding layers 137 may include nickel-plated Ma-Mo metallization. Suitable materials for the seals 138 may include silver-copper alloy.

The electrodes 132, 134 may be formed of any suitable material. According to some embodiments, the electrodes 132, 134 are formed of metal and, in some embodiments, are formed of molybdenum or Kovar. According to some embodiments, each of the electrodes 132, 134 is unitary and, in some embodiments, monolithic.

As discussed above, the inner electrodes E1-E14 are serially positioned and distributed in the cavity 120 along the axis B-B. The electrodes E1-E14 are positioned such that each electrode E1-E14 is physically spaced apart from the immediately adjacent other inner electrode(s) E1-E14, 132, 134. The lower edge of each electrode E1-E14 is captured in slots defined between associated ones of the locator tabs 116 to thereby limit lateral displacement of the electrode E1-E14 relative to the housing 102. Each electrode E1-E14 is also captured between the bottom wall 112 and the trigger device 150 to thereby limit axial displacement (along axis A-A) of the electrode E1-E14 relative to the housing 102.

In this manner, each electrode E1-E14 is positively positioned and retained in position relative to the housing 102 and the other electrodes E1-E14, 132, 134. In some embodiments, the electrodes E1-E14 are secured in this manner without the use of additional bonding or fasteners applied to the electrodes E1-E14. The electrodes E1-E14 may be semi-fixed or loosely captured between the locator features 116, the bottom wall 112 and the triggering device 150. The electrodes E1-E14 may be capable of floating up and down to a limited degree within the housing 102.

The electrodes E1-E14 are each arcuate, bent or curved plates. More particularly, each electrode E1-E14 has an arcuate, or curvilinear cross-sectional shape or profile in the plane defined by the lateral axes B-B and C-C, and is straight, flat or linear in planes parallel to the plane defined by the axes A-A and C-C. The opposing surfaces of the electrodes E1-E14 extend substantially parallel to one another. This configuration permits a greater gap length within a housing 102 of a given width and for the electrodes to have similar lengths.

The electrodes E1-E14 may be formed of any suitable material. According to some embodiments, the electrodes E1-E14 are formed of metal and, in some embodiments, are formed of molybdenum, copper, tungsten or steel. According to some embodiments, each of the electrodes E1-E14 is unitary and, in some embodiments, monolithic.

According to some embodiments, each of the electrodes E1-E14 has a thickness T1 (FIG. 6) in the range of from about 0.3 to 2 mm and, in some embodiments, in the range of from about 0.5 to 1 mm. According to some embodiments, each electrode E1-E14 has a height H1 (FIG. 7) in the range of from about 1 to 20 mm and, in some embodiments, in the range of from 3 to 10 mm. According to some embodiments, the length of each electrode E1-E14 is in the range of from about 10 to 50 mm.

The insulator 136 may be shaped as a flat plate or otherwise configured. The insulator 136 may be formed of any suitable electrically insulating material. According to some embodiments, the insulator 136 is formed of a material having a melting point of at least 1000 degrees Celsius and, in some embodiments, at least 1600 degrees Celsius. In some embodiments, the insulator 136 is formed of a ceramic. In some embodiments, the insulator 136 includes or is formed of alumina ceramic ($Al_2O_3$) and, in some embodiments, at least about 90% $Al_2O_3$. In some embodiments, the insulator 136 is monolithic.

The cover plate 130 may be shaped as a flat plate or otherwise configured. The cover plate 130 may be formed of any suitable material. According to some embodiments, the cover plate 130 is formed of metal and, in some embodiments, is formed of copper or Kovar. According to some embodiments, the cover plate 130 is unitary and, in some embodiments, monolithic.

An annular bonding layer 139 is interposed between an annular top edge surface 118 of the insulator 110 and the lower surface of the cover 130. The seal 135 is interposed between the bonding layer 139 and the cover 130. The cover 130 is bonded to the surface 118 by the bonding layer 139. According to some embodiments, the cover 130 is bonded to the surface 118 by the bonding layer 139 continuously about the full periphery of the opening 122 so that the opening 122 is hermetically sealed by the cover 130 and the bonding layer 139 and the seal 135. The bonding layer 139 may be formed of the same material as described above for the bonding layer 137. The seal layer 135 may be formed of the same material as described above for the seals 138.

The trigger device 150 (FIGS. 3, 4 and 7-9) includes a substrate 152, a plurality of resistor links R1-R14 (FIG. 8), and a conductor link 162. The resistor links R1-R14 and the conductor link 162 constitute a trigger circuit 151.

The substrate 152 includes a body 154 and an integral annular flange 156. Recesses 158 are defined in the top side 154A of the body 154 and communicate with through holes 159 that extend to the bottom side 154B of the body 154. A channel 157 is also defined in the top side 154A.

The substrate 152 may be formed of any suitable electrically insulating material. According to some embodiments, the substrate 152 is formed of a material having a melting temperature of at least 1000 degrees Celsius and, in some embodiments, at least 1600 degrees Celsius. In some embodiments, the substrate 152 is formed of a ceramic. In some embodiments, the substrate 152 includes or is formed of alumina ceramic ($Al_2O_3$) and, in some embodiments, at least about 90% $Al_2O_3$. In some embodiments, the substrate 152 is monolithic.

Figure 7:
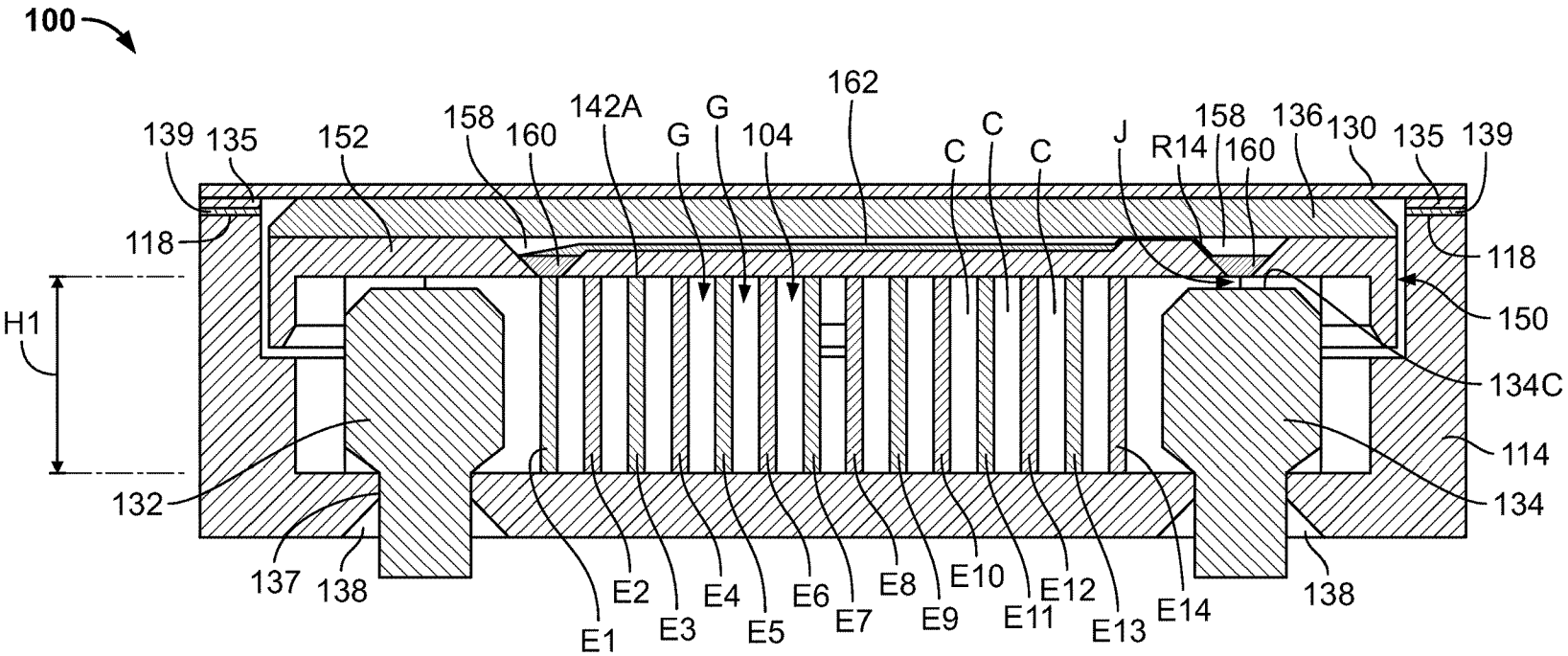
FIG. 7 is cross-sectional view of the GDT of FIG. 1 taken along the line 7-7 of FIG. 6.
Figure 8:
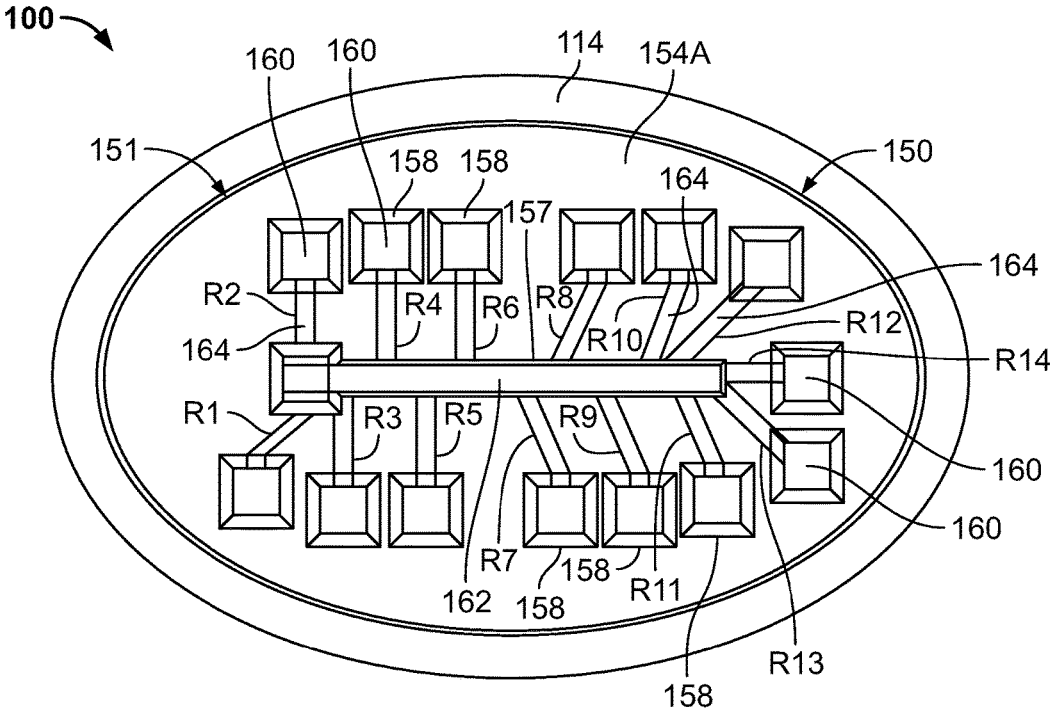
FIG. 8 is a fragmentary top plan view of the GDT of FIG. 1.
Figure 9:
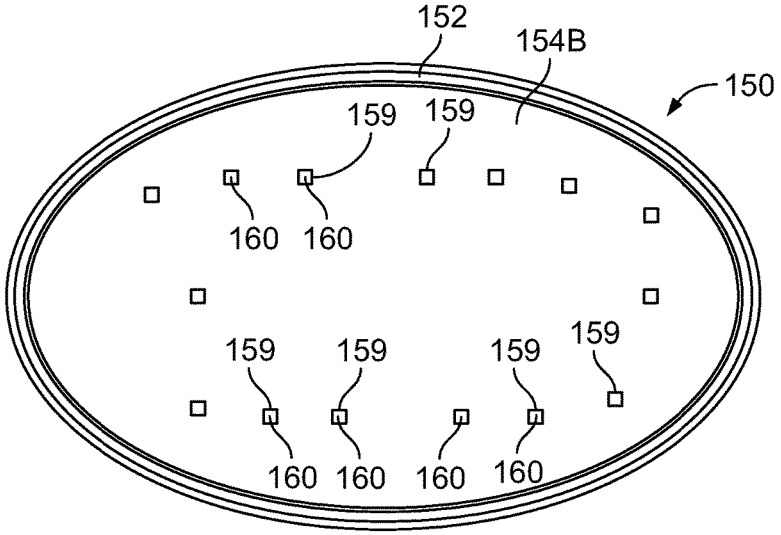
FIG. 9 is a bottom plan view of a trigger device forming a part of the GDT of FIG. 1.

With reference to FIGS. 7-9, the connecting layer 162 is bonded to the top surface of the substrate 152 in the channel 157. Each resistor link R1-R14 includes a resistor layer 164 and a terminal interface layer 160. Each resistor link R1-R14 is terminated on one end by the connecting layer 162 and by its terminal interface layer 160 on its opposing end. The terminal interface layers 160 are thereby electrically connected to the connecting layer through the resistor layers 164. The terminal interface layers 160 are bonded to the top surface of the substrate 152 in respective ones of the recesses 158. The terminal interface layers 160 extend to and may extend into the through holes 159.

The connecting layer 162 may be formed of any suitable material. According to some embodiments, the connecting layer 162 is formed of metal and, in some embodiments, is formed of metal in an adhesive carrier. In some embodiments, the carrier is a silicate-based adhesive carrier such as a sodium silicate or potassium silicate adhesive. According to some embodiments, the connecting layer 162 has a thickness in the range of from about 50 to 1000 micrometers.

The terminal interface layers 160 may be formed of any suitable material. According to some embodiments, the terminal interface layers 160 are formed of metal and, in some embodiments, are formed of metal in an adhesive carrier. In some embodiments, the carrier is a silicate-based adhesive carrier such as a sodium silicate or potassium silicate adhesive. According to some embodiments, each of the terminal interface layers 160 has a thickness in the range of from about 50 to 1000 micrometers.

The resistor layers 164 may be formed of any suitable electrically resistive material. According to some embodiments, the resistor layers 164 are formed of graphite-based compound. According to some embodiments, the resistor layers 164 are formed of a compound including graphite in an adhesive carrier. In some embodiments, the carrier is a silicate-based adhesive carrier such as a sodium silicate or potassium silicate adhesive.

According to some embodiments, the resistor layers 164 are formed of a material having a specific electrical resistance in the range of from about 1 micro-ohm-meter to 1 ohm-meter.

According to some embodiments, each of the resistor links R1-R14 has an electrical resistance in the range of from about 3 to 500 ohms.

According to some embodiments, each of the resistor layers 164 has a thickness in the range of from about 1 to 150 micrometers.

The gas M may be any suitable gas, and may be a single gas or a mixture of two or more (e.g., 2, 3, 4, 5, or more) gases. According to some embodiments, the gas M includes at least one inert gas. In some embodiments, the gas M includes at least one gas selected from argon, neon, helium, hydrogen, and/or nitrogen. According to some embodiments, the gas M is or includes helium. In some embodiments, the gas M may be air and/or a mixture of gases present in air.

According to some embodiments, the gas M may comprise a single gas in any suitable amount, such as, for example, in any suitable amount in a mixture with at least one other gas. In some embodiments, the gas M may comprise a single gas in an amount of about 0.1%, 0.5%, 1%, 5%, 10%, 15%, 20%, 25%, 30%, 35%, 40%, 45%, 50%, 55%, 60%, 65%, 70%, 75%, 80%, 85%, 90%, 95%, 98%, or 99% by volume of the total volume of gas present in the GDT chamber 104, or any range therein. In some embodiments, the gas M may comprise a single gas in an amount of less than 50% (e.g., less than 40%, 30%, 20%, 10%, 5%, or 1%) by volume of the total volume of gas present in the GDT chamber 104. In some embodiments, the gas M may comprise a single gas in an amount of more than 50% (e.g., more than 60%, 70%, 80%, 90%, or 95%) by volume of the total volume of gas present in the GDT chamber 104. In some embodiments, the gas M may comprise a single gas in an amount in a range of about 0.5% to about 15%, about 1% to about 50%, or about 50% to about 99% by volume of the total volume of gas present in the GDT chamber 104. In some embodiments, the gas M comprises at least one gas present in an amount of at least 50% by volume of the total volume of gas present in the GDT chamber 104. According to some embodiments, the gas M comprises helium in an amount of at least 50% by volume of the total volume of gas present in the GDT chamber 104. According to some embodiments, the gas M comprises at least one gas present in an amount of about 90% or more by volume of the total volume of gas present in the GDT chamber 104, and, in some embodiments, in an amount of about 100% by volume of the total volume of gas present in the GDT chamber 104.

According to some embodiments, the gas M may comprise a mixture of a first gas and a second gas (e.g., an inert gas) different from the first gas with the first gas present in an amount of less than 50% by volume of the total volume of gas present in the GDT chamber 104 and the second gas present in an amount of at least 50% by volume of the total volume of gas present in the GDT chamber 104. In some embodiments, the first gas is present in an amount in a range of about 5% to about 20% by volume of the total volume of gas present in the GDT chamber 104 and the second gas is present in an amount of about 50% to about 90% by volume of the total volume of gas present in the GDT chamber 104. In some embodiments, the first gas is present in an amount of about 10% by volume of the total volume of gas present in the GDT chamber 104 and the second gas is present in an amount of about 90% by volume of the total volume of gas present in the GDT chamber 104. In some embodiments, the second gas is helium, which may be present in the proportions described above for the second gas. In some embodiments, the first gas (which may be present in the proportions described above for the first gas) is selected from the group consisting of argon, neon, hydrogen, and/or nitrogen, and the second gas is helium (which may be present in the proportions described above for the second gas).

The GDT 100 may be assembled as follows. The terminal electrodes 132 and 134 are inserted through the openings 159. The bonding layers 137 are heated to bond the terminals 132, 134 to the insulator 110 in the openings 124. The seals 138 are installed or formed about the posts 132B, 134B to secure the electrodes 132, 134 in place and hermetically seal the openings 159. According to some embodiments, the seals 138 are metal solder or brazings, which may be formed of silver-copper alloy, for example.

The inner electrodes E1-E14 are installed in the cavity 120. More particularly, the electrodes E1-E14 are each installed in a respective set of slots between the locator features 116 as shown in FIG. 6.

The trigger device 150 is placed over the inner electrodes E1-E14 so that the bottom side 154B rests on the top edges 142A (FIG. 7) of the inner electrodes E1-E14. The trigger device 150 is aligned such that the through holes 159 are each aligned with a respective one of top edges 142A of the electrodes E1-E14, 134, and the interface layers 160 therein are located on or closely adjacent said respective top edges 142A.

The insulator plate 136 and the cover 130 are then placed over the trigger device 150. The cover 130 is bonded to the top face 118 of the insulator 110 to form the housing 102 and gas-tight sealed chamber 104. According to some embodiments, the cover 130 is sealingly secured to the insulator 110 by brazing or heating the cover 130 and thereby melt-bonding the bonding layer 139 to the cover 130. The bonding layer 139 may be sprayed onto or otherwise applied to the insulator 110.

In some embodiments, the components of the GDT 100 are disposed in an assembly chamber during the steps of placing the cover 130 on the insulator 110 and securing the cover 130 to the insulator 110 to enclose and seal the chamber 104. The assembly chamber is filled with the gas M at a prescribed pressure and temperature. As a result, the gas M is thereafter captured and contained in the chamber 104 of the assembled GDT 100 at a prescribed pressure and temperature. The prescribed pressure and temperature are selected such that the gas M is present at a desired operational pressure when the GDT 100 is installed and in use at a prescribed service temperature.

In some embodiments, the pressure of the gas M in the chamber 104 of the assembled GDT 100 is in the range of from about 50 to 1000 mbar at 20 degrees Celsius.

According to some embodiments, the relative dimensions of the insulator 110, the electrodes E1-E14, the trigger device 150, the insulator plate 136, and the cover 130 are selected such that the electrodes E1-E14 are loosely captured between the substrate 152 and the insulator bottom wall 112 to permit the electrodes E1-E14 to slide up and down a small distance. In some embodiments, the permitted vertical float distance is in the range of from about 0.05 to 0.5 mm. In other embodiments, the substrate 152 and the bottom wall 112 fit snuggly against or apply a compressive load to the electrodes E1-E14.

The electrodes 132, E1-E14, 134 define a plurality of gaps G and a plurality of cells C between each pair of electrodes 132, E1-E14, 134. According to some embodiments, the minimum width W1 (FIG. 6) of each gap G (i.e., the smallest gap distance between the two electrode surfaces forming the cell C) is in the range of from about 0.2 to 1.5 mm.

The through holes 159 associated with the resistor links R1-R14 are positioned over the top edges 142A, 134C of the electrodes E1-E14 and 134, respectively. As a result, the terminal layer 160 of each resistor link R1-R14 is positioned on or closely adjacent the corresponding top edge 142A, 134C through the corresponding through hole 159.

In use, the resistor links R1-R14 are electrically coupled to the electrodes E1-E14, 134 through their respective terminal layers 160. Because the electrodes E1-E14 are floating or not fully fixed in the housing 102 and the terminal electrode 134 is spaced from the trigger device 150, it may not be possible to ensure tight contact between the resistor links R1-R14 and the electrodes E1-E14, 134. As a result, a small gap J (FIG. 7) may be present between each resistor link R1-R14 and its electrode E1-E14, 134. According to some embodiments, each gap J has a width in the range of from about 0 to 0.5 mm. During a surge event, this gap J may cause sparking between the resistor link R1-R14 and the electrode E1-E14, 134. If the sparking is applied to the resistor layer 164, such sparking may damage the resistor layer 164, which may in turn enlarge the gap and adversely affect performance of the GDT 100 (e.g., increase the required spark over voltage).

The terminal interface layers 160 can prevent or reduce such damage to the resistor links R1-R14 and thereby improve the performance and service life of the GDT 100. The material of the terminal interface layers 160 has an electrical conductivity substantially the same as the electrode and greater than that of the resistor layer 164 so that the aforementioned sparking is eliminated or reduced. Moreover, the material of the terminal interface layers 160 may be more resistant to degradation from etching than the material of the resistor layer 164.

Advantageously, the plurality of spark gaps G are housed or enveloped in the same housing 102 and chamber 104. The plurality of cells C and spark gaps G defined between the electrodes 132, E1-E14, 134 are in fluid communication so that they share the same mass or volume of gas M. By providing multiple electrodes, cells and spark gaps in one common or shared chamber 104, the size and number of parts can be reduced. As a result, the size, cost and reliability of the GDT 100 can be reduced as compared to a plurality of individual GDTs connected in series.

Moreover, the trigger device 150 including the trigger circuit 151 is housed or enveloped in the same housing 102 and chamber 104 as the electrodes 132, E1-E14, 134, and is likewise in fluid communication with the same mass of gas M. As a result, the size, cost and reliability of the GDT 100 can be reduced as compared to a plurality of individual GDTs connected in series with an external trigger circuit.

The arcuate configurations of the electrodes E1-E14 can help to ensure that, in the case of a surge event, spark over occurs between the midsections of the electrodes E1-E14, not at their edges.

The floating or semi-fixed mounting of the electrodes E1-E14 in the housing 102 can facilitate ease of assembly.

The performance attributes of the GDT 100 can be determined by selection of the gas M, the pressure of the gas M in the chamber 104, the dimensions and geometrics of the electrodes 132, E1-E14, 134, the geometry and dimensions of the housing 102, the sizes of the gaps G, and/or the electrical resistances of the resistor links R1-R14.

Figure 10:
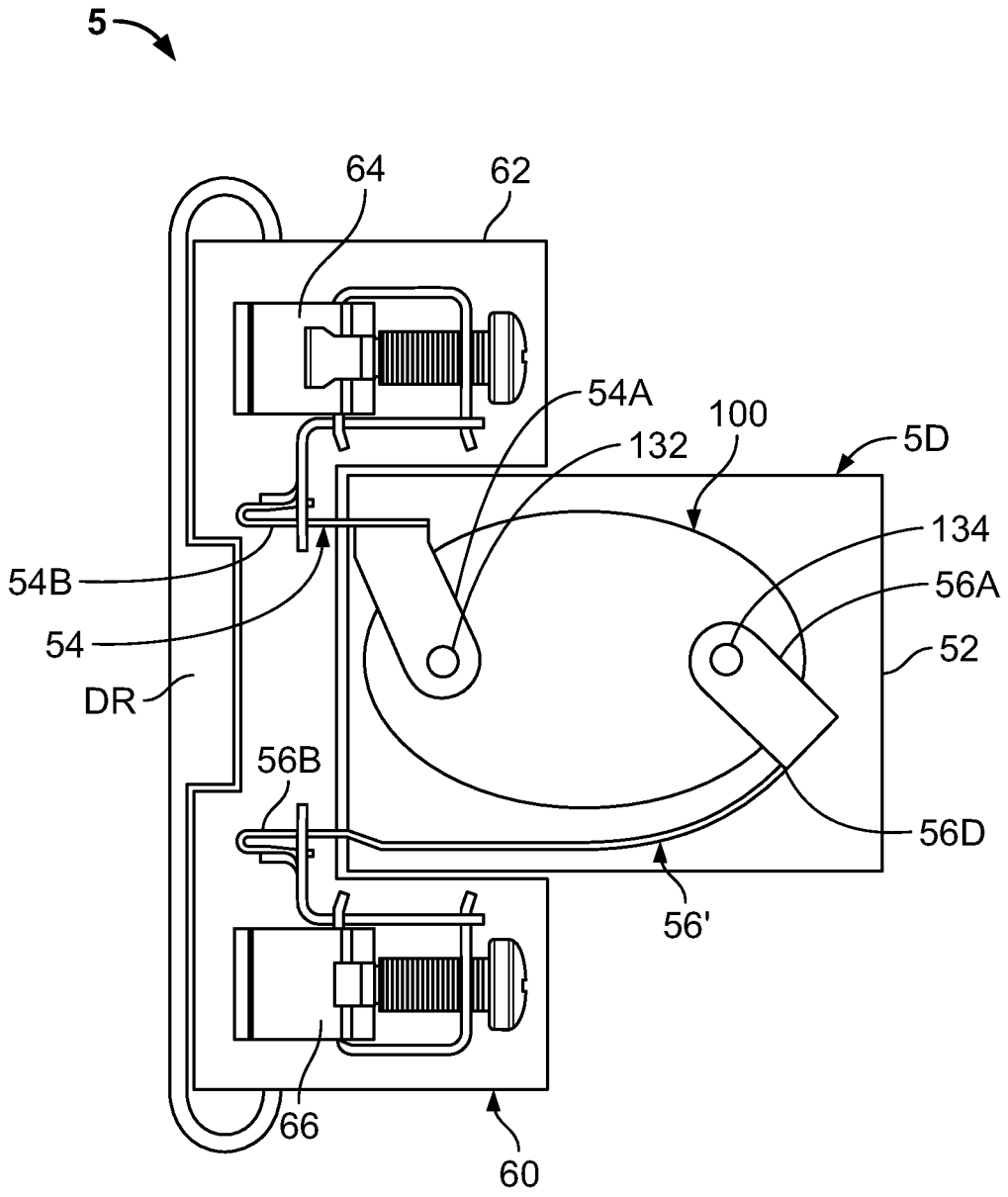
FIG. 10 is a schematic view of an electrical assembly including the GDT of FIG. 1.

In some embodiments and with reference to FIG. 10, an electrical assembly 5 according to embodiments of the invention is shown therein. The electrical assembly 5 incorporates the GDT 100. The GDT 100 is mounted in an enclosure 52 of a GDT module 50 that is removeably and replaceably mounted on a base 60. The base 60 is in turn mounted on a support DR to mechanically and electrically connect the GDT 100 to an electrical power system. In some embodiments, the support DR is a DIN rail. The base 60 includes an enclosure 62, a first electrical connector 64 to which a first electrical wire WL (e.g., a line wire) is secured and a second electrical connector 66 to which a second electrical wire WN (e.g., a neutral wire) is secured. The GDT module 50 includes a jumper 54 including connectors 54A and 54B. The connector 54A is secured to the terminal electrode 132 and the connector 54B is releasably interlocked with the base connector 64. The GDT module 50 further includes a second jumper 56 including connectors 56A and 56B. The connector 56A is secured to the terminal electrode 134 and the connector 56B is releasably interlocked with the base connector 66. The jumper 56 may further include a thermal disconnector mechanism 56D.

Figure 11A:
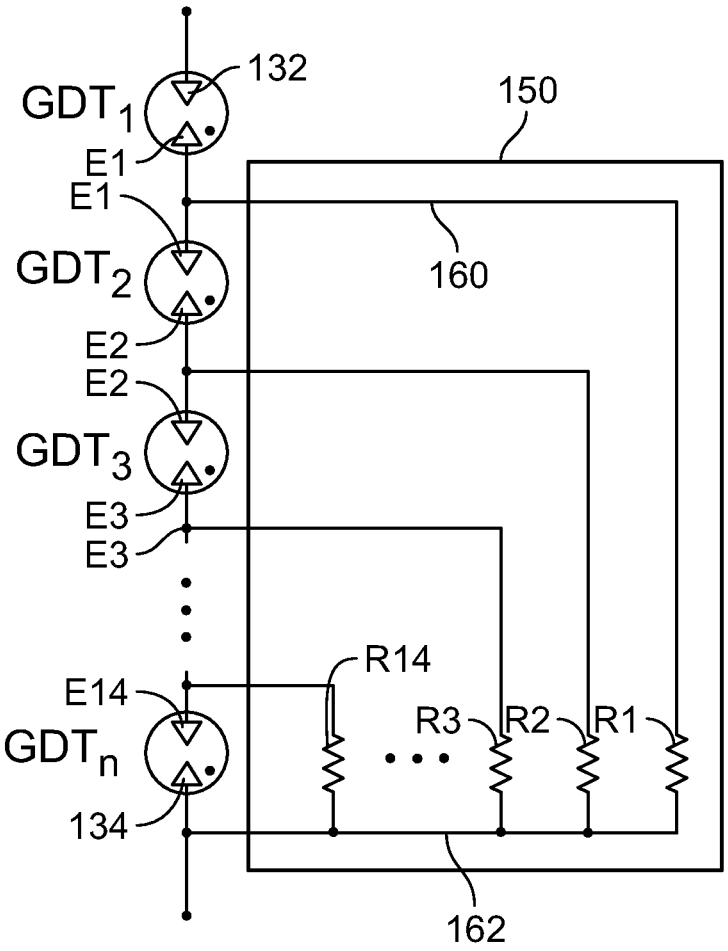
FIGS. 11A and 11B are electrical schematic circuits representing two different embodiments corresponding to the GDT of FIG. 1.

Brief reference is now made to FIG. 11A, which is an electrical schematic circuit of a modular, multi-cell gas discharge tube 100 as illustrated in FIGS. 1-9 according to some embodiments of the present invention. As illustrated, in the electrical schematic context, the modular, multi-cell gas discharge tube 100 may include a plurality of single cell GDTs that are arranged serially between terminals 132 and 134. For example, a first terminal 132 and the inner electrode E1 may function as a first single cell $GDT_1$, the inner electrode E1 and the inner electrode E2 may function as a second single cell $GDT_2$ that is serially connected to the first single cell $GDT_1$ and so on.

Additionally, a trigger circuit 150 may include multiple resistors R1-R14 that may be connected between respective ones of the inner electrodes E1-E14 and the terminal 134. In some embodiments, the resistors R1-R14 include resistive layers 164 and are electrically conductively coupled to the connecting layer 162 and interface layers 160. As described above, the modular, multi-cell gas discharge tube 100 provides that the interface layers 160 are electrically conductively coupled to the inner electrodes E1-E14.

In use and operation, the first terminal 132 may be connected to a line or phase voltage of a single or multi-phase power system and the second terminal 134 may be connected to a neutral line of the single or multi-phase power system. The total arcing voltage of the modular, multi-cell gas discharge tube 100 generally corresponds to the sum of the arcing voltage of individual series connected single cell GDTs and thus exceeds the peak value of the system voltage. As such, when the modular, multi-cell gas discharge tube 100 is in conduction mode, the current flowing therethrough will be generally limited to the current corresponding to a surge event, such as lighting, and not from the system source.

Under normal (i.e., non-conducting) conditions, since no current is flowing through $GDT_1$, then no current is flowing through R1 and the voltage across $GDT_1$ is the same as the line-neutral voltage at the second terminal 134. When an overvoltage is applied to the system, the overvoltage will be applied to the first terminal 132, which is the top electrode of $GDT_1$. Since the lower electrode of $GDT_1$, which is the inner electrode E1, is at the same potential as the second terminal 134, $GDT_1$ begins to conduct electrical current and the overvoltage is applied to the second $GDT_2$, which includes inner electrodes E1 and E2. Also, once $GDT_1$ begins to conduct, a small current will flow through resistor R1. In some embodiments, the current may only flow through resistor R1 until $GDT_2$ begins to conduct, which may be a very short period of time. For example, current may only flow through R1 for a time interval that is less than 1 microsecond.

As provided above, as soon as $GDT_1$ begins conducting, the overvoltage is applied to $GDT_2$, which then begins to conduct. Once $GDT_2$ begins to conduct, the overvoltage is applied to $GDT_3$, which then begins to conduct. Similarly, resistor R2 will conduct a small amount of current once $GDT_2$ begins conducting until $GDT_3$ begins to conduct. Once each of the series connected single cell GDTs conducts current, the GDTs stay in conduction mode until the overvoltage condition has ceased. Once the overvoltage condition ceases, the GDTs cease to conduct because the peak value of the system voltage is less than the total arcing voltage of the modular, multi-cell gas discharge tube 100.

The quantity of gaps in the modular, multi-cell gas discharge tube 100 may vary depending on the operating voltage of the system. For example, for a 255V application, a modular, multi-cell gas discharge tube 100 may use between 14 and 21 total gaps between the terminal 132, the inner electrodes E1-E14 and the terminal 134. Some embodiments provide that the quantity of gaps may be less than 14 if the system voltage is correspondingly less than the examples provided herein and the quantity of gaps may be greater than 21 if the system voltage is correspondingly greater than the examples provided herein.

Additionally, some embodiments provide that the resistance values of resistors R1-R14 may be in a range between about 3 Ohms to about 500 Ohms, however, such embodiments are non-limiting and the resistance values may be less than 3 Ohms and/or greater than 500 Ohms. In some embodiments, the resistance values of resistors R1-R14 may all be the same, while in other embodiments the resistor values of resistors R1-R14 may be different from one another.

Figure 11B:
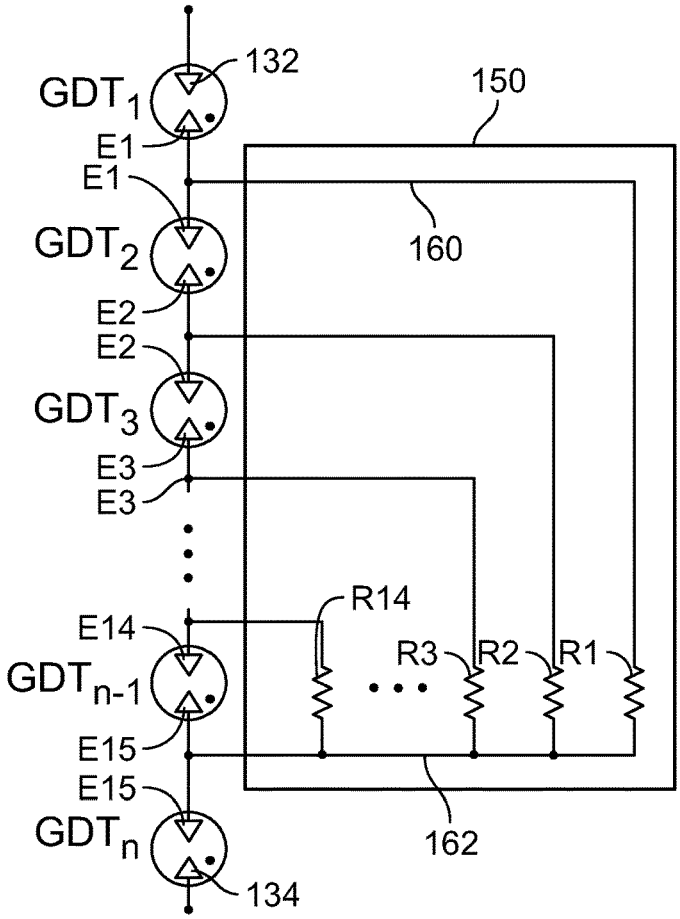
Figure 12:
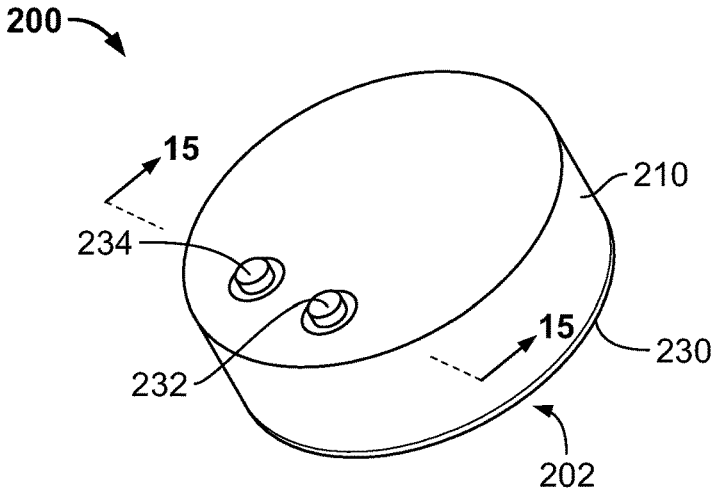
FIG. 12 is a bottom perspective view of a gas discharge tube (GDT) according to further embodiments of the invention.
Figure 13:
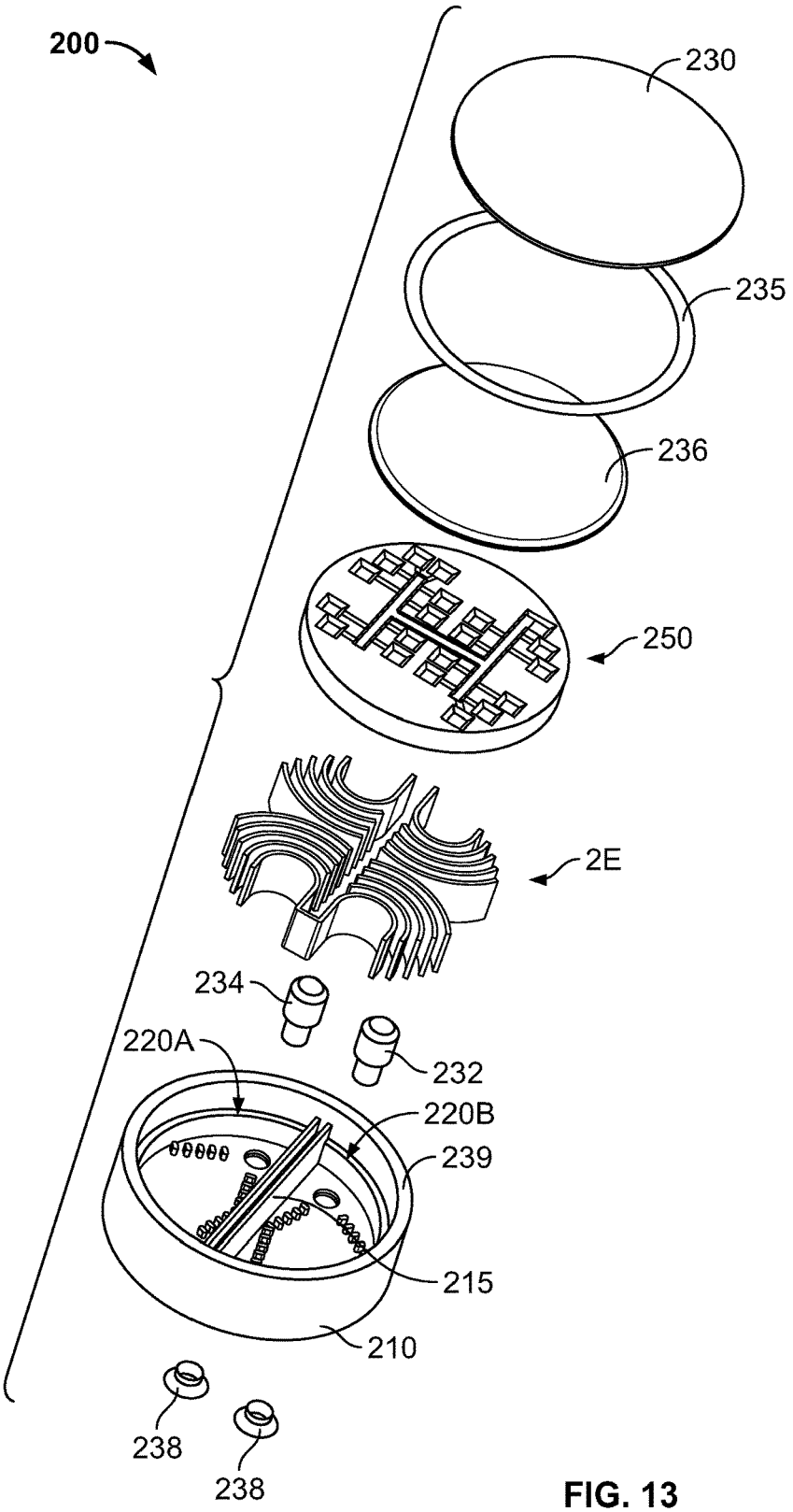
FIG. 13 is an exploded, top perspective view of the GDT of FIG. 12.
Figure 14:
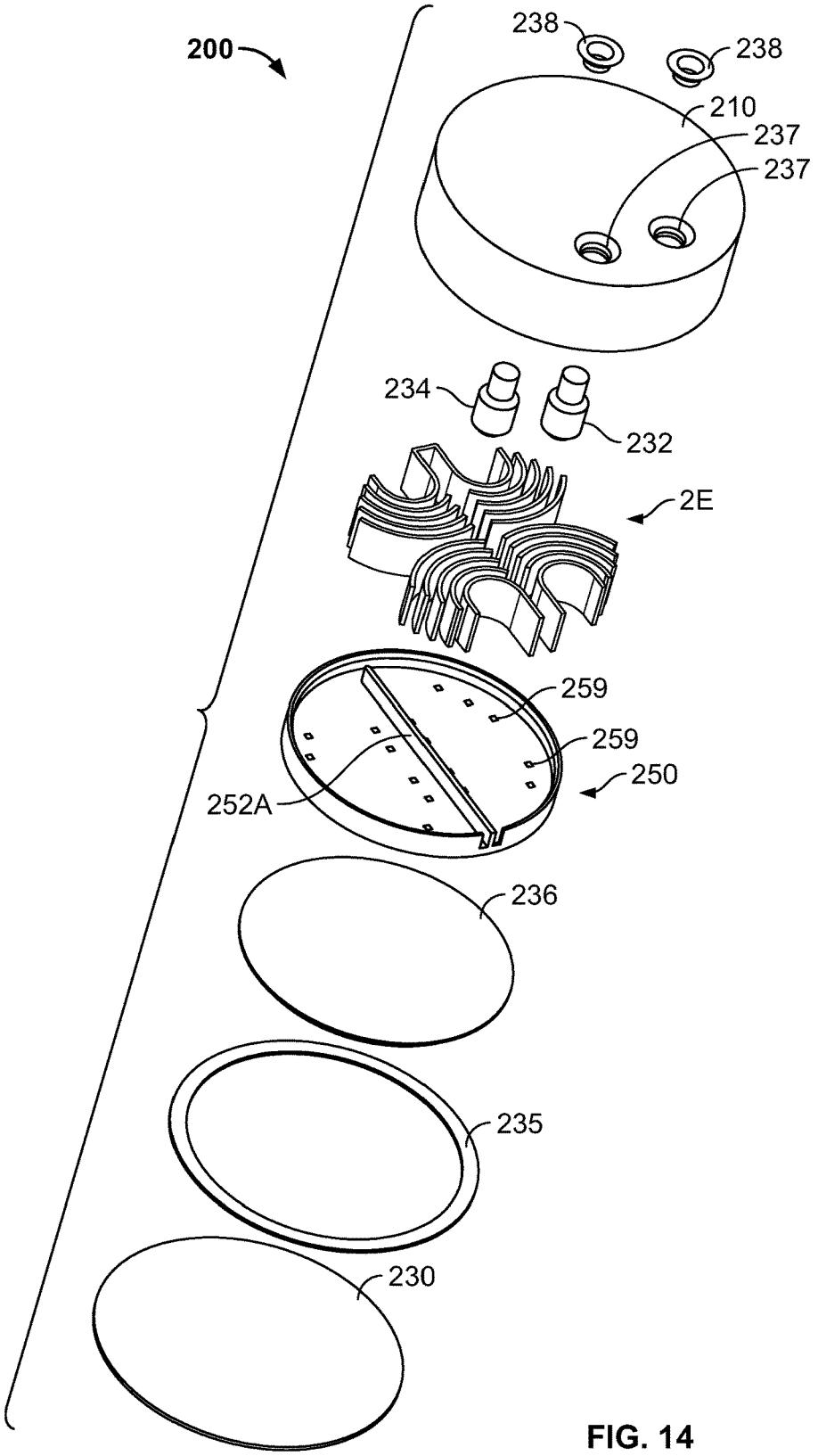
FIG. 14 is an exploded, bottom perspective view of the GDT of FIG. 12.
Figure 15:
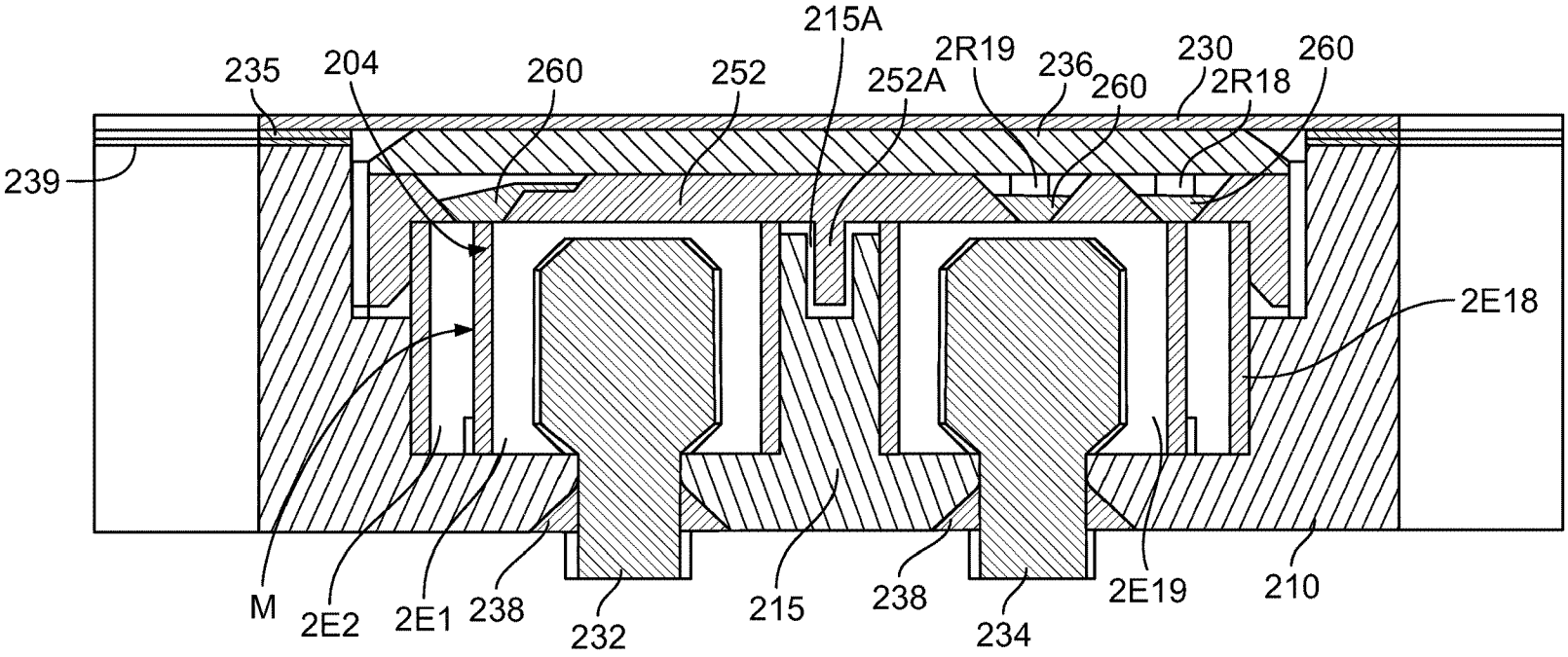
FIG. 15 is cross-sectional view of the GDT of FIG. 12 taken along the line 15-15 of FIG. 12.
Figure 16:
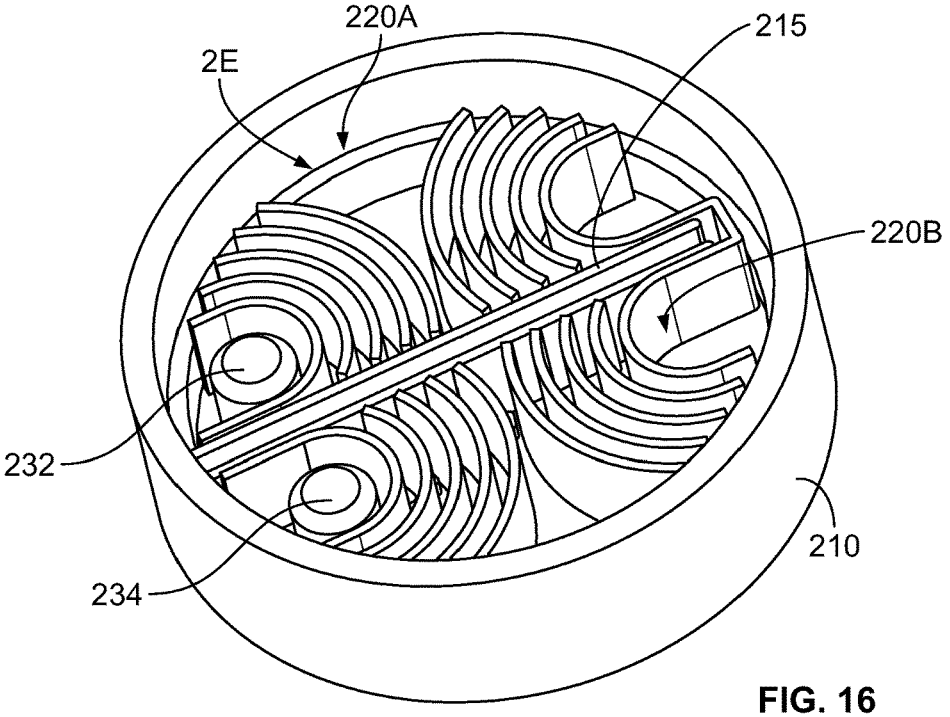
FIG. 16 is a fragmentary top perspective view of the GDT of FIG. 12.
Figure 17:
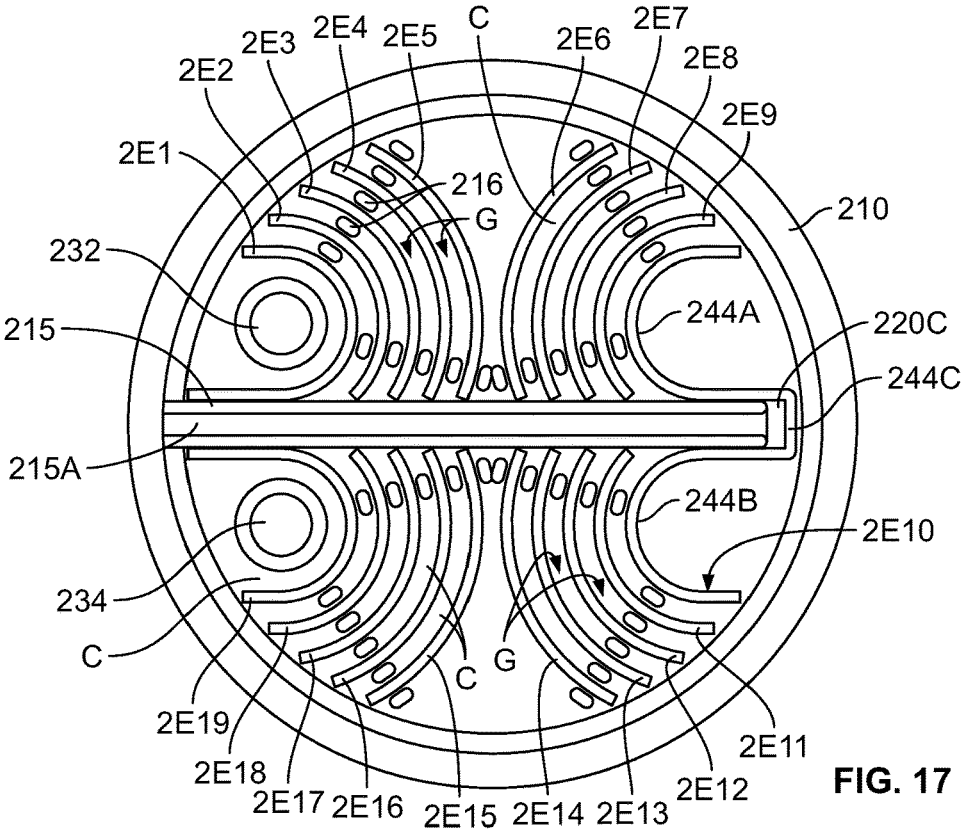
FIG. 17 is a fragmentary top plan view of the GDT of FIG. 12.
Figure 18:
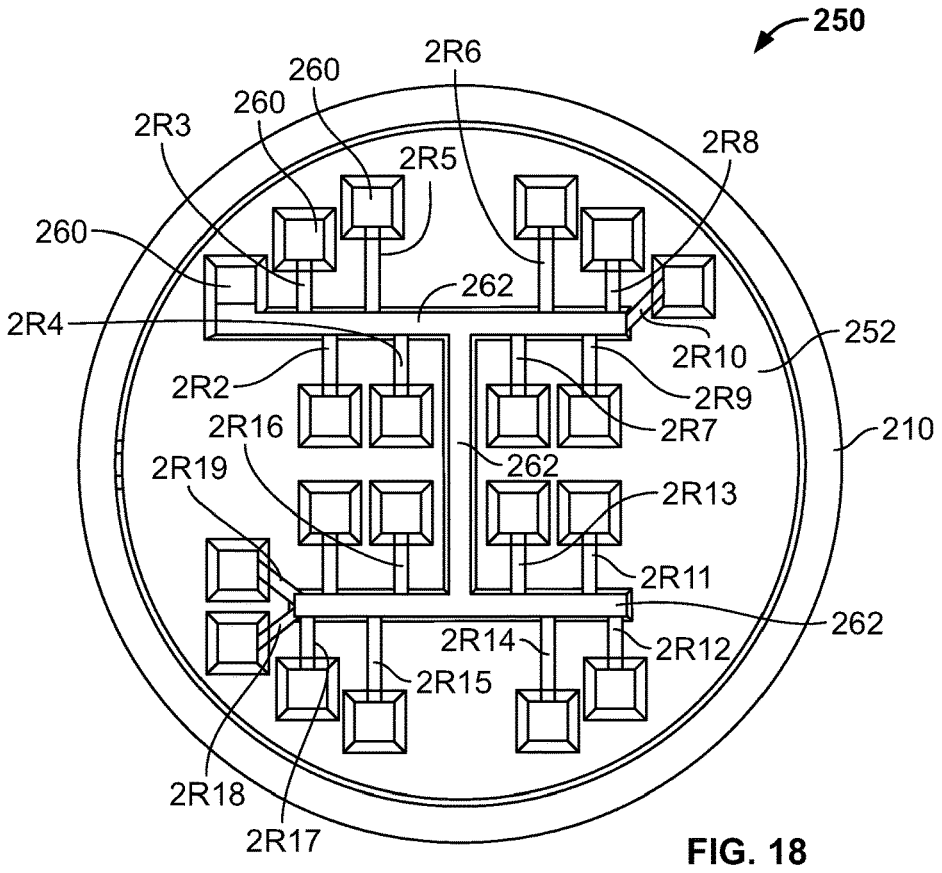
FIG. 18 is a fragmentary top plan view of the GDT of FIG. 12.
Figure 19:
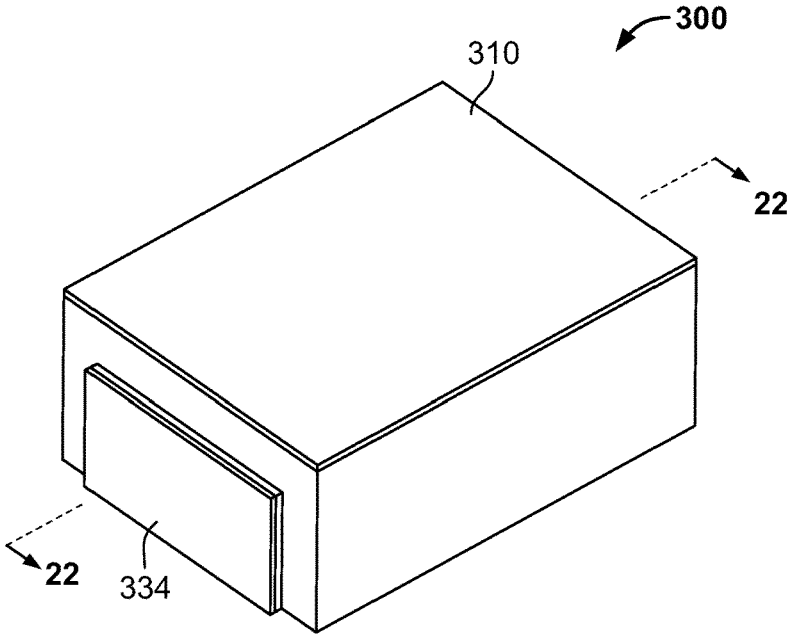
FIG. 19 is a top perspective view of a gas discharge tube (GDT) according to further embodiments of the invention.
Figure 20:
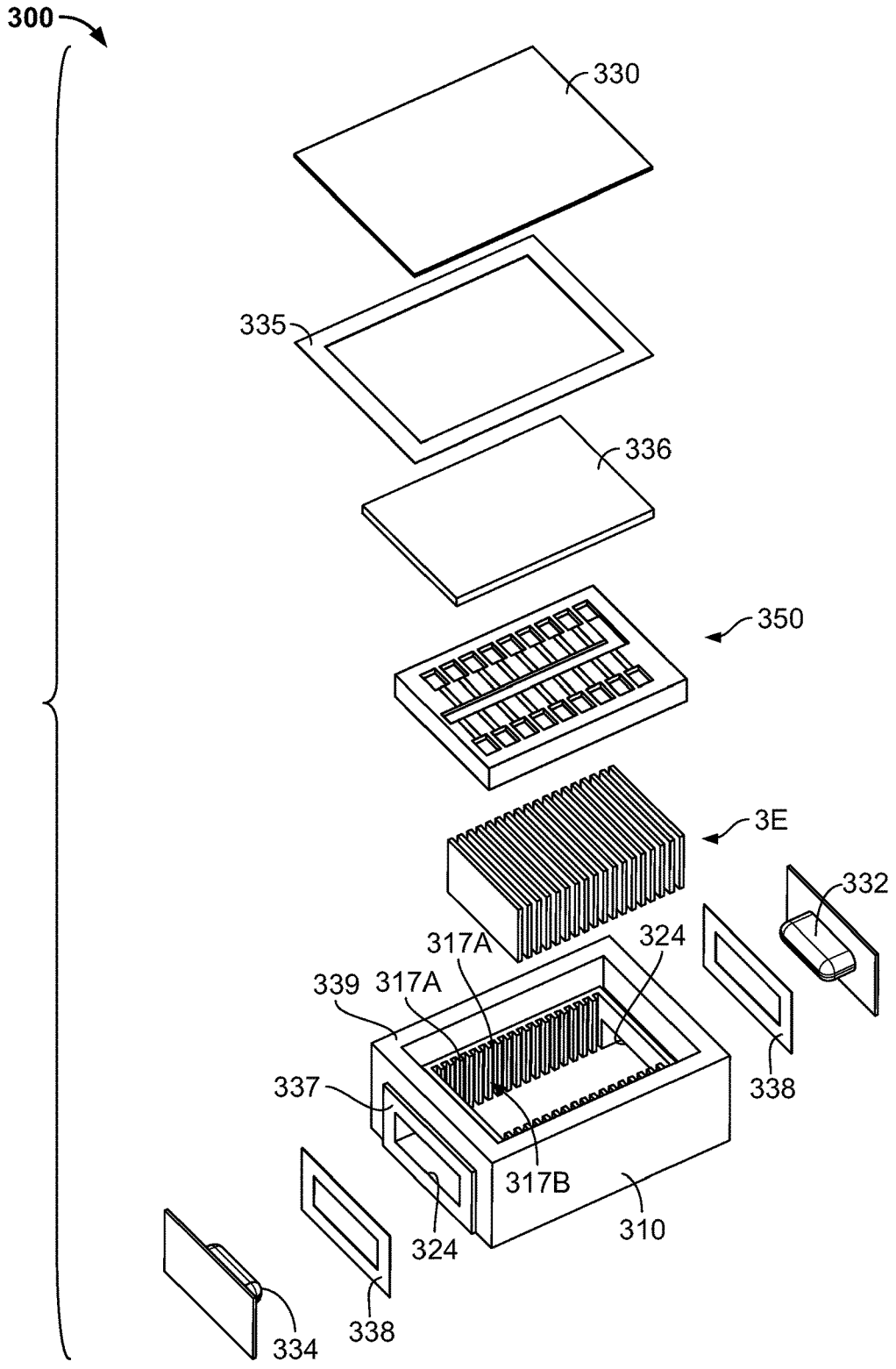
FIG. 20 is an exploded, top perspective view of the GDT of FIG. 19.
Figure 21:
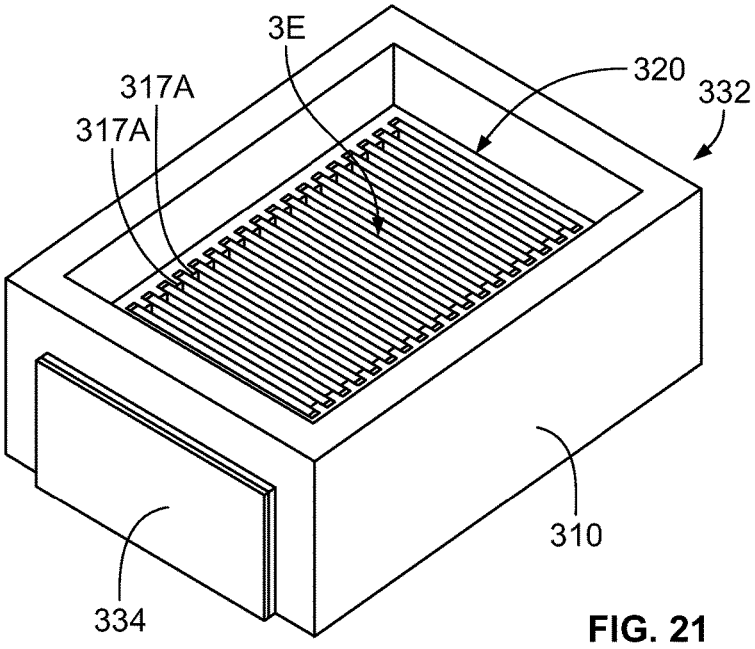
FIG. 21 is a fragmentary top perspective view of the GDT of FIG. 19.
Figure 22:
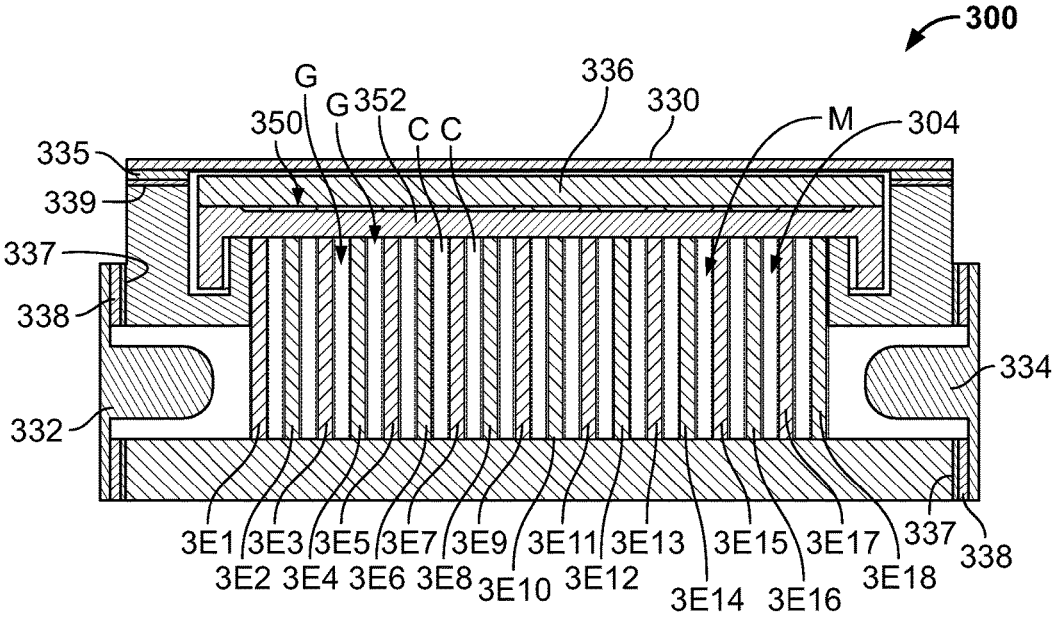
FIG. 22 is cross-sectional view of the GDT of FIG. 12 taken along the line 22-22 of FIG. 19.
Figure 23:
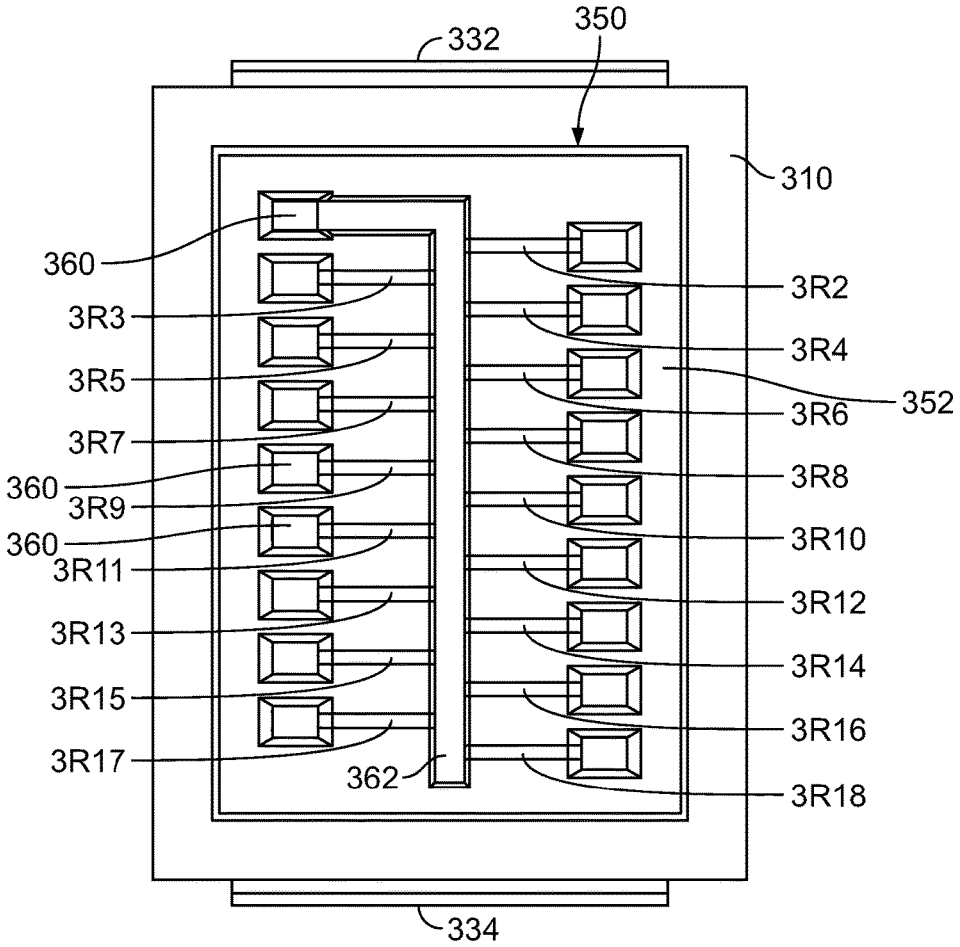
FIG. 23 is a fragmentary top plan view of the GDT of FIG. 19.
Figure 24:
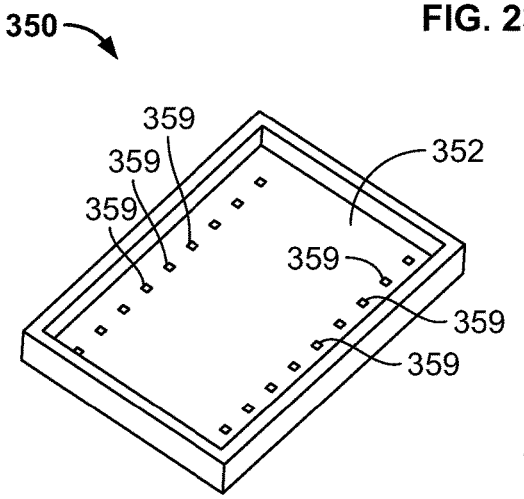
FIG. 24 is a bottom perspective view of a trigger device forming a part of the GDT of FIG. 19.
Figure 25:
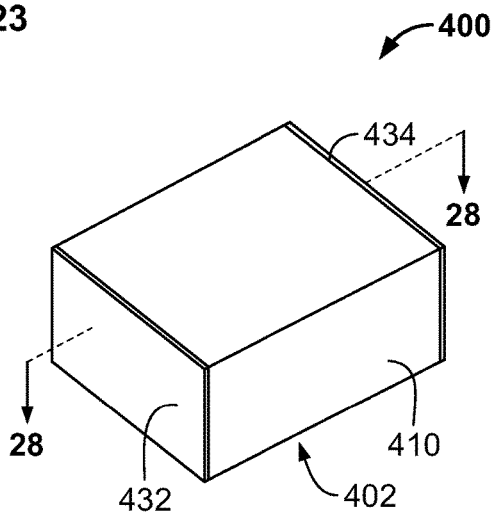
FIG. 25 is a top perspective view of a gas discharge tube (GDT) according to further embodiments of the invention.
Figure 26:
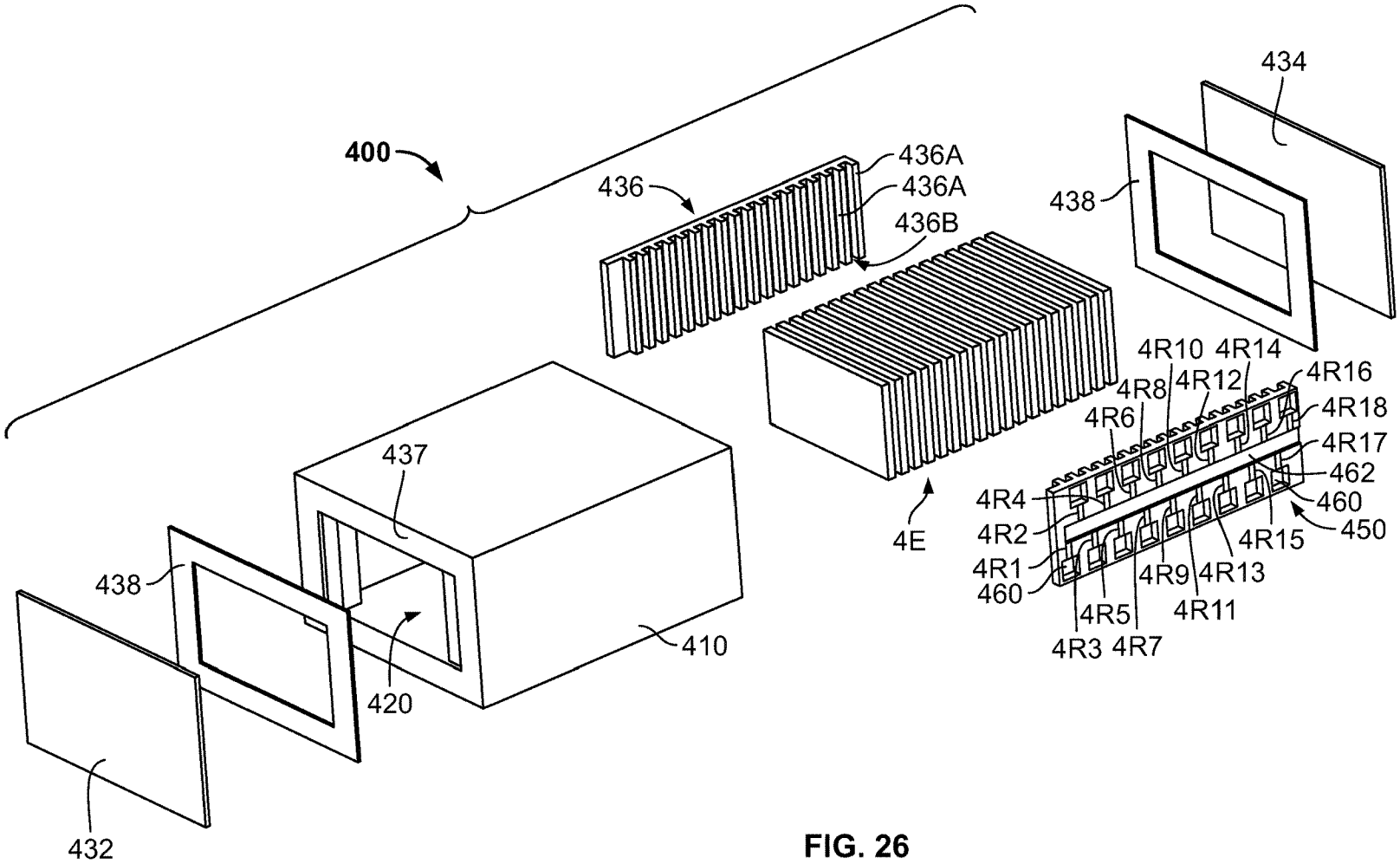
FIG. 26 is an exploded, top perspective view of the GDT of FIG. 25.

Brief reference is now made to FIG. 11B, which is an electrical schematic circuit of a modular, multi-cell gas discharge tube 100 as illustrated in FIGS. 1-9 according to some other embodiments of the present invention. Many elements as discussed above regarding FIG. 11A are substantially the same and thus duplicative discussion thereof will be omitted. As illustrated, an additional gap corresponding to $GDT_n$ may be added in series with the circuit of FIG. 11A. In this manner, instead of a single GDT (e.g., $GDT_1$) beginning to conduct to trigger the remaining GDTs into conduction, both $GDT_1$ and $GDT_n$ must begin conducting to trigger the conduction of the other GDTs. An advantage of having both $GDT_1$ and $GDT_n$ to begin conducting is that if either of $GDT_1$ or $GDT_n$ short circuit or begin to degrade, a gap will still be present in the other GDT and the device may still function. Such advantage may provide increased safety in operation, although response time may be increased.

Although the use and operation described above are provided in the context of the modular, multi-cell gas discharge tube 100, the description of the use and operation may be application to other embodiments described herein.

With reference to FIGS. 12-18, a modular, multi-cell GDT 200 according to further embodiments of the invention is shown therein. The GDT 200 includes an insulator 210, a cover 230, a first terminal electrode 232, a second terminal electrode 234, a set 2E of inner electrodes 2E1-2E19, an insulator 236, seals 235, 238, bonding layers 237, 239, a trigger device 250, and a selected gas M corresponding to the insulator 110, the cover 130, the first terminal electrode 132, the second terminal electrode 134, the inner electrodes E1-E14, the insulator 136, the seals 135, 138, the bonding layers 137, 139, the trigger device 150, and the selected gas M of the GDT 100, except as follows.

The electrodes 2E1-2E19, the trigger device 250, and the gas M are all contained in a hermetically sealed chamber 204 in a housing 202 formed by the insulator 210 and the cover 230.

The insulator 210 includes an integral ceramic partition wall 215 that bisects the cavity 220. The partition wall 215 divides the cavity 220 into subcavities 220A, 220B. The substrate 252 of the trigger device 250 includes an integral ceramic rib 252A that is received in a groove 215A defined in the top edge of the partition wall 215. The insulator 210, the cavity 220 and the chamber 204 are cylindrically shaped.

The terminal electrodes 232, 234 are secured and sealed by the bonding layers 237 and the seals 238 in openings 224 on the same lateral end of the cavity 220 and opposite sides of the partition wall 215.

The arcuate inner electrodes 2E1-2E9 are secured in the subcavity 220A and the arcuate inner electrodes 2E11-2E19 are secured in the subcavity 220B. The inner electrode 2E10 includes an integral first portion 244A in the subcavity 220A and an integral second portion 244B in the subcavity 220B. The electrode portions 244A, 244B are connected by an integral connecting portion 244C that extends through a slot 220C defined between the sidewall 214 and an end of the partition wall 215. The electrodes 2E1-2E19 are each arcuate, curved or bent plates that are curvilinear in lateral profile and straight in axial profile. The electrodes 2E1-2E19 are captured to be semi-fixed or floating by the locator features 216, the sidewall 214 and the partition wall 215.

The trigger device 250 includes a ceramic substrate 252, connecting layers 262, and resistor links 2R2-2R19 corresponding to the ceramic substrate 152, connecting layers 162, and resistor links R1-R14 of the GDT 100. The terminal interface layers 260 of the first connecting layer 262 and the resistor links 2R2-2R19 are positioned on or closely adjacent the top edges of the electrodes 2E1-2E19 and 234, respectively, through the through holes 259 in the substrate 252.

The GDT 200 includes twenty spark gaps G and twenty cells C. In use, spark over occurs sequentially from the electrode 232, through the electrodes 2E1-2E19 and to the electrode 234. Spark over directly between the electrodes 2E1-2E9 in the subcavity 220A and the electrodes 2E11-2E19 in the subcavity 220B is prevented by the electrically insulating partition wall 215 and rib 252A. The trigger device 250 operates in the same manner as described above with regard to the trigger device 150 to control the firing sequence and timing.

With reference to FIGS. 19-24, a modular, multi-cell GDT 300 according to further embodiments of the invention is shown therein. The GDT 300 includes an insulator 310, a cover 330, a first terminal electrode 332, a second terminal electrode 334, a set 3E of inner electrodes 3E1-3E18, an insulator 336, seals 335, 338 bonding layers 337, 339, a trigger device 350, and a selected gas M corresponding to the insulator 110, the cover 130, the first terminal electrode 132, the second terminal electrode 134, the inner electrodes E1-E14, the insulator 136, the seals 135, 138, the bonding layers 137, 139, the trigger device 150, and the selected gas M of the GDT 100, except as follows. The electrodes 3E1-3E18, the trigger device 350, and the gas M are all contained in a hermetically sealed chamber 304 in a housing 302 formed by the insulator 310 and the cover 330.

The insulator 310 includes integral ribs 317A defining locator slots 317B therebetween. Opposed end openings 324 communicate with the cavity 320. The insulator 310, the cavity 320 and the chamber 304 are rectangular in cross-section.

The terminal electrodes 332 and 334 are secured and sealed by the bonding layers 337 in the openings 324. The inner electrodes 3E1-3E18 are substantially flat plates with opposed planar faces. The electrodes 3E1-3E18 are seated in the slots 317B and thereby semi-fixed or floatingly mounted in the chamber 304.

The trigger device 350 includes a ceramic substrate 352, connecting layers 362, and resistor links 3R2-3R18 corresponding to the ceramic substrate 152, connecting layers 162, and resistor links R1-R14 of the GDT 100. The terminal interface layers 360 of the connecting layer 362 and the resistor links 3R2-3R18 are positioned on or closely adjacent the top edges of the electrodes 3E1-3E18 and 334, respectively, through the through holes 359 in the substrate 352.

The GDT 300 includes nineteen spark gaps G and nineteen cells C. In use, spark over occurs sequentially from the electrode 332, through the electrodes 3E1-3E18 and to the electrode 334. The trigger device 350 operates in the same manner as described above with regard to the trigger device 150 to control the firing sequence and timing.

With reference to FIGS. 25-29, a modular, multi-cell GDT 400 according to further embodiments of the invention is shown therein. The GDT 400 includes an insulator 410, a first terminal electrode 432, a second terminal electrode 434, a set 4E of inner electrodes 4E1-4E18, an insulator 436, bonding layers 437, seals 438, a trigger device 450, and a selected gas M corresponding to the insulator 110, the first terminal electrode 132, the second terminal electrode 134, the inner electrodes E1-E14, the insulator 136, the bonding layer 137, the seal 138, the trigger device 150, and the selected gas M of the GDT 100, except as follows.

The electrodes 4E1-4E18, the trigger device 450, and the gas M are all contained in a hermetically sealed chamber 404 in a housing 402 formed by the insulator 410 and the electrodes 432, 434.

The insulator 410 is generally tubular and has opposed end openings 424 communicating with the cavity 420. The insulator 410, the cavity 420 and the chamber 404 are rectangular in cross-section.

The insulator 436 is a plate having integral ribs 436A defining locator slots 436B therebetween.

The trigger device 450 includes a ceramic substrate 452, connecting layers 462, and resistor links 4R1-4R18 corresponding to the ceramic substrate 152, connecting layers 162, and resistor links R1-R18. The substrate 452 includes integral ribs 453B defining locator slots 453B therebetween.

The inner electrodes 4E1-4E18 are substantially flat plates with opposed planar faces.

Figure 27:
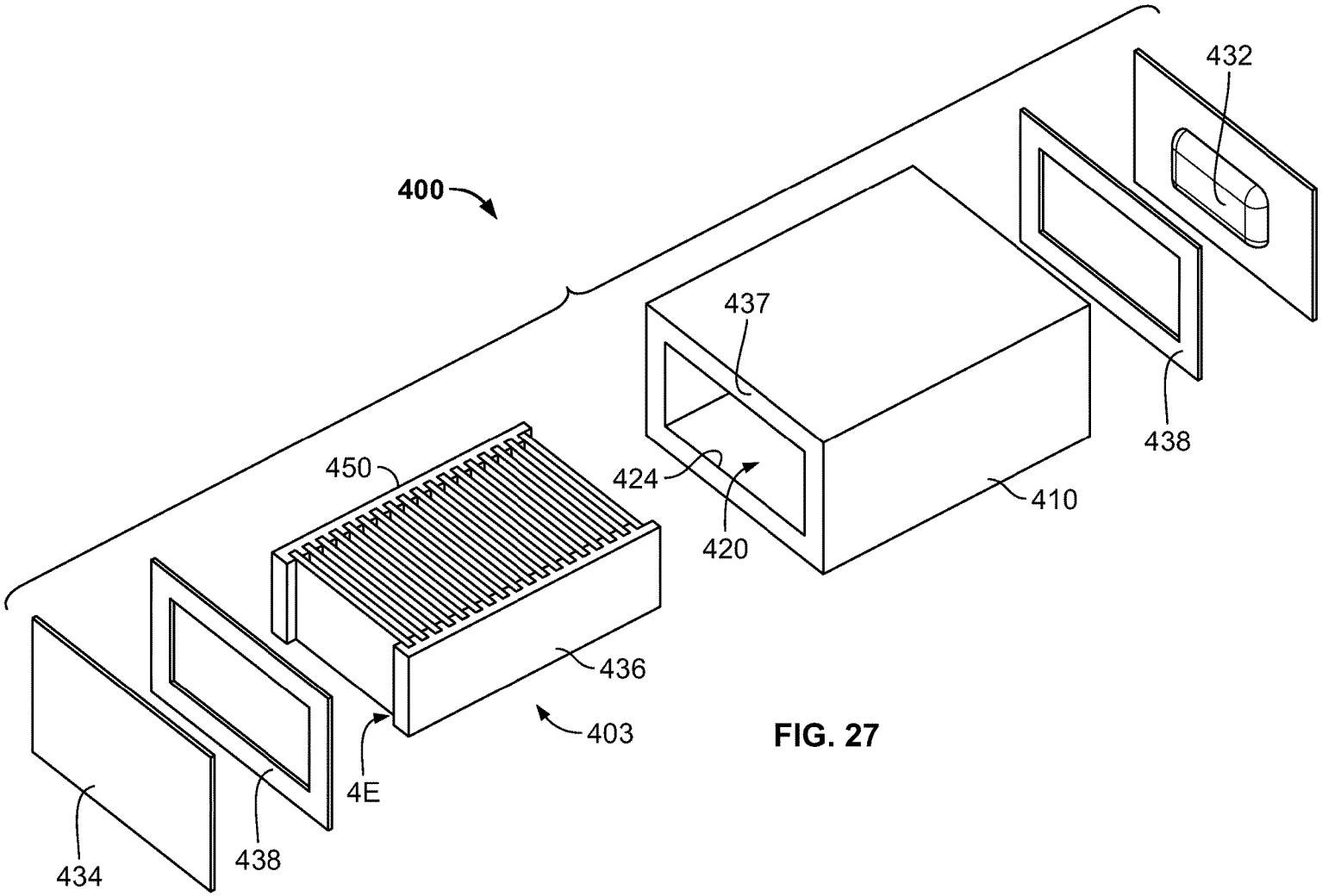
FIG. 27 is an exploded, top perspective view of the GDT of FIG. 25.
Figure 28:
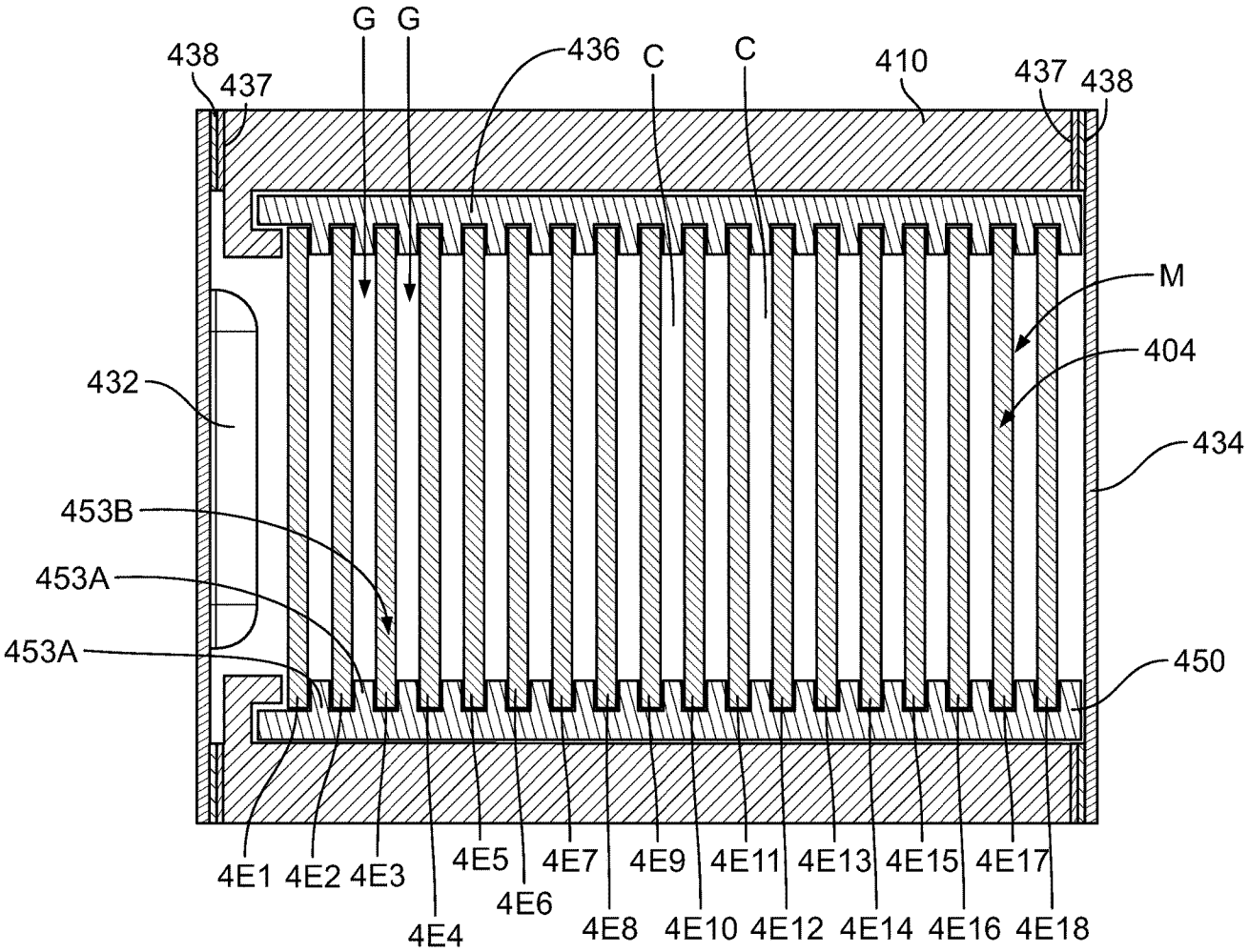
FIG. 28 is cross-sectional view of the GDT of FIG. 25 taken along the line 28-28 of FIG. 25.
Figure 29:
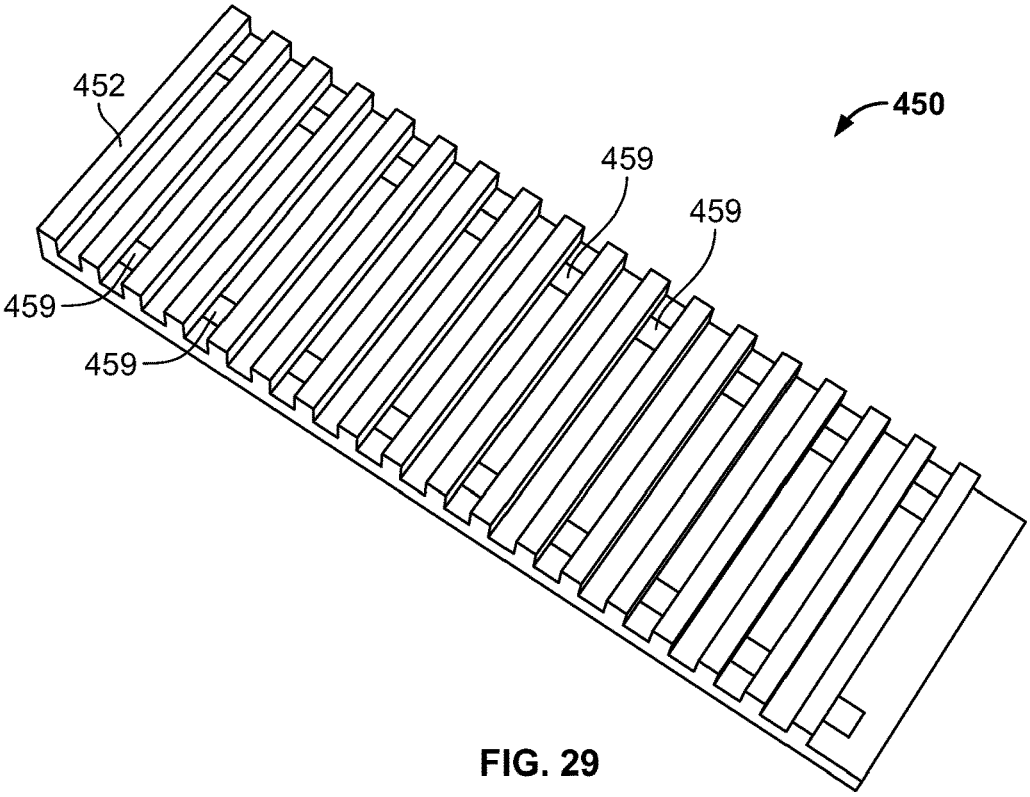
FIG. 29 is a bottom perspective view of a trigger device forming a part of the GDT of FIG. 25.
Figure 30:
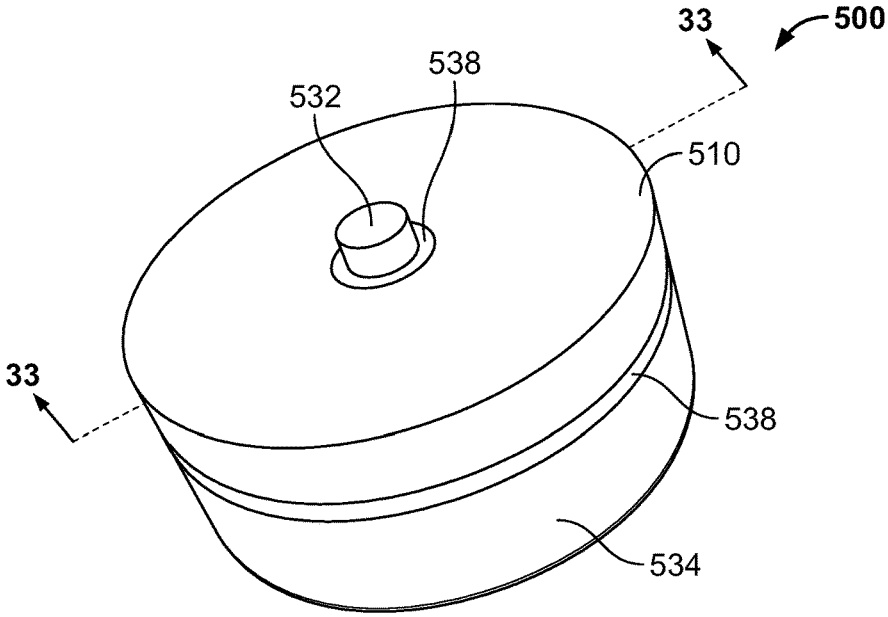
FIG. 30 is a top perspective view of a gas discharge tube (GDT) according to further embodiments of the invention.
Figure 31:
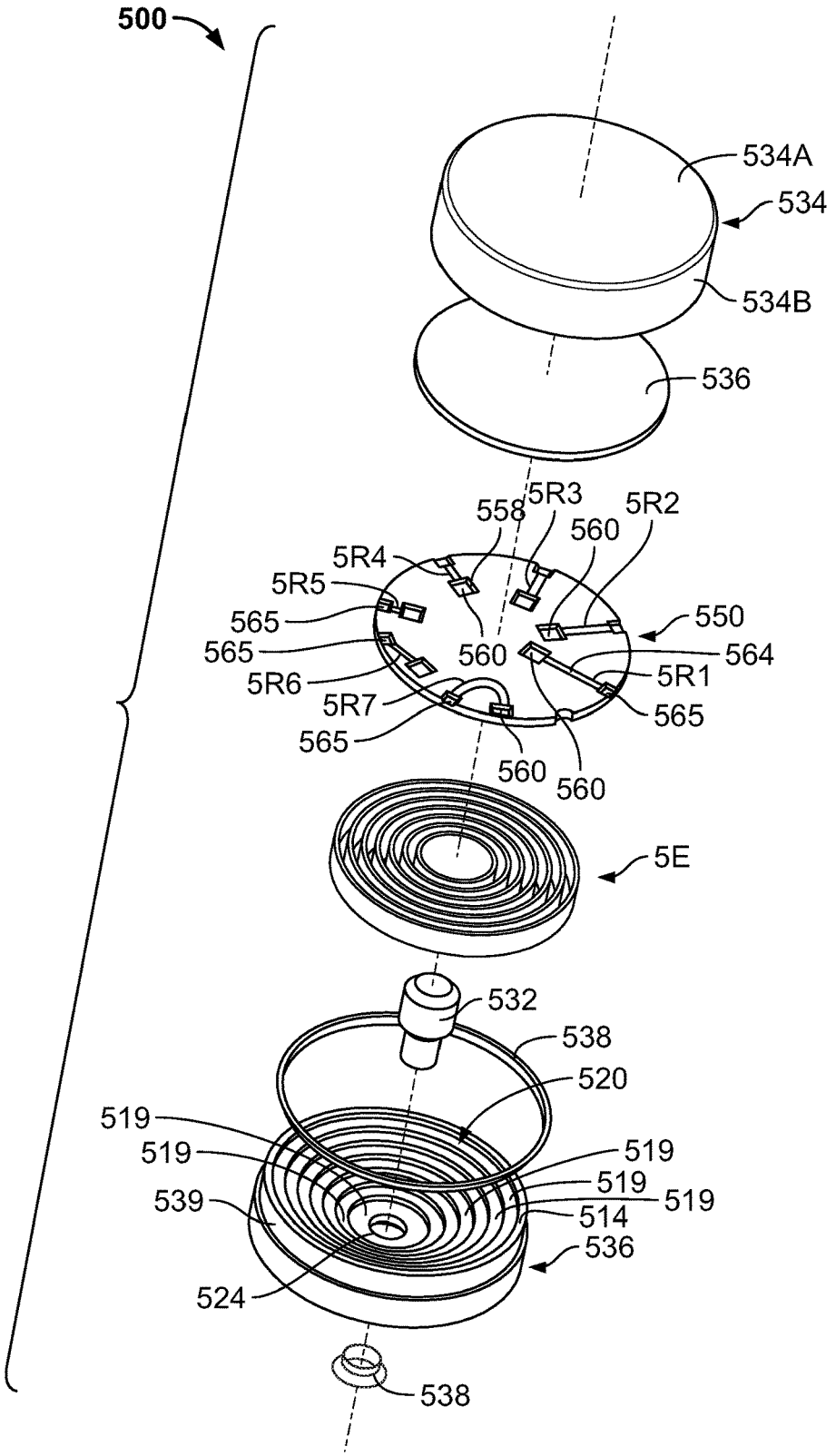
FIG. 31 is an exploded, bottom perspective view of the GDT of FIG. 30.
Figure 32:
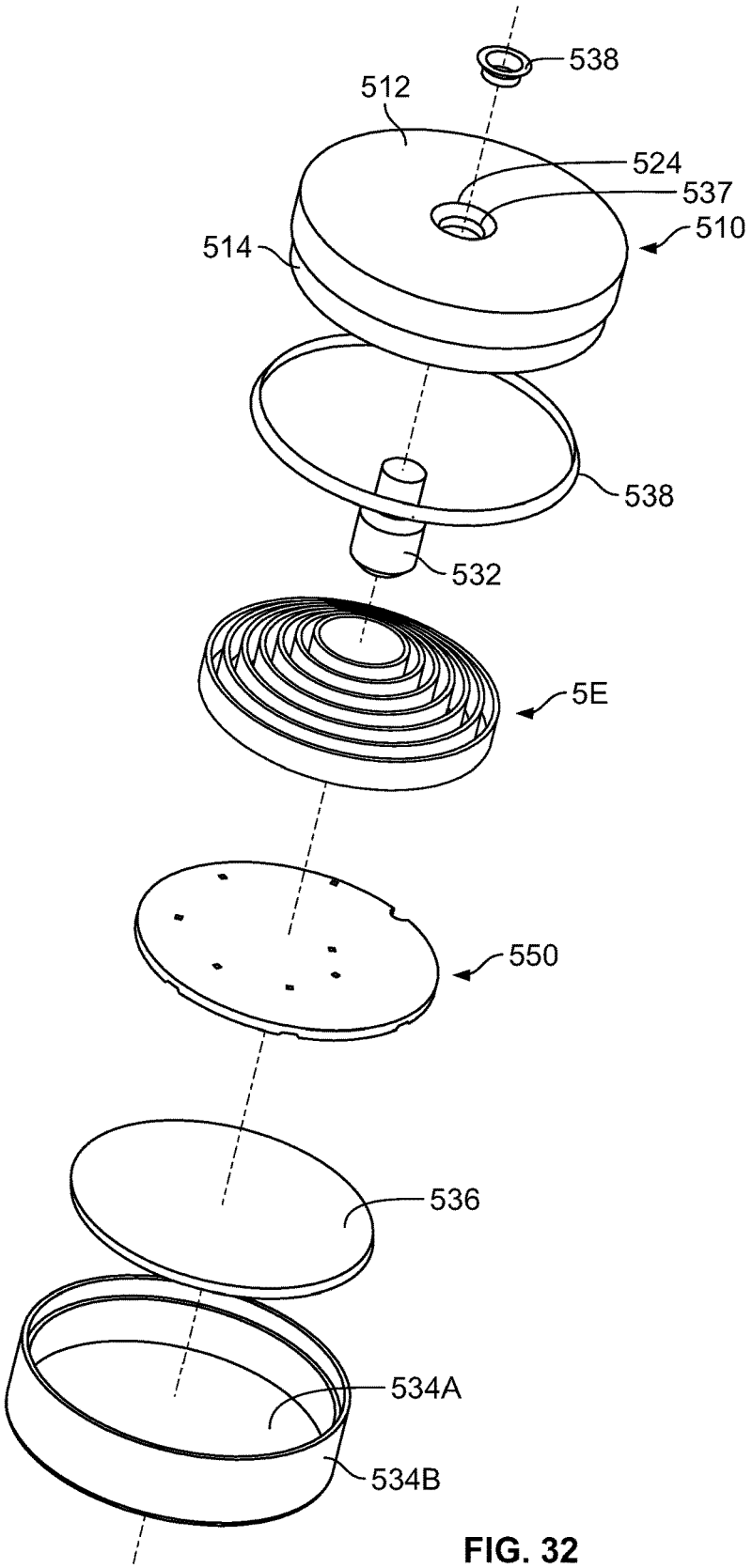
FIG. 32 is an exploded, top perspective view of the GDT of FIG. 30.
Figure 33:
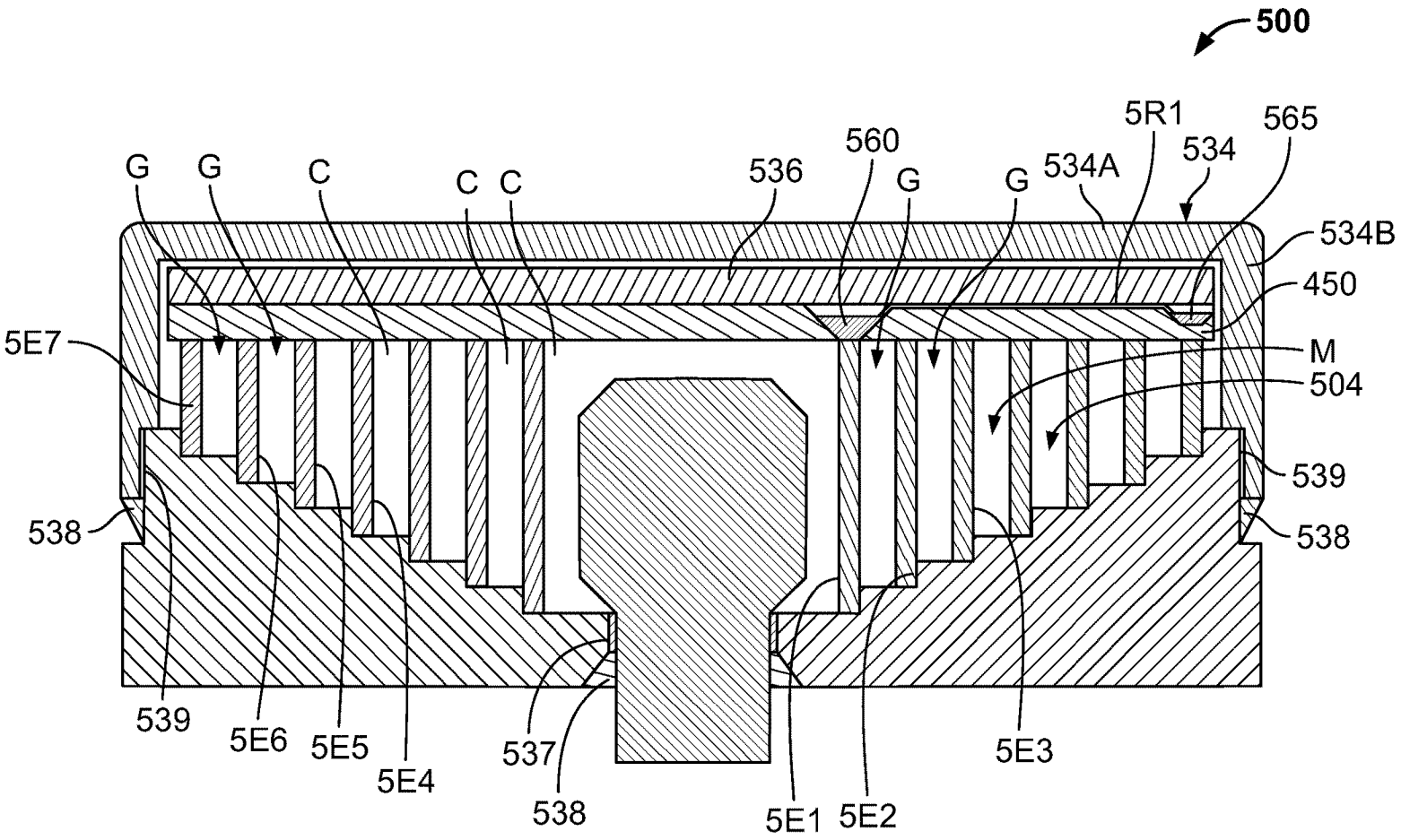
FIG. 33 is cross-sectional view of the GDT of FIG. 30 taken along the line 33-33 of FIG. 30.
Figure 34:
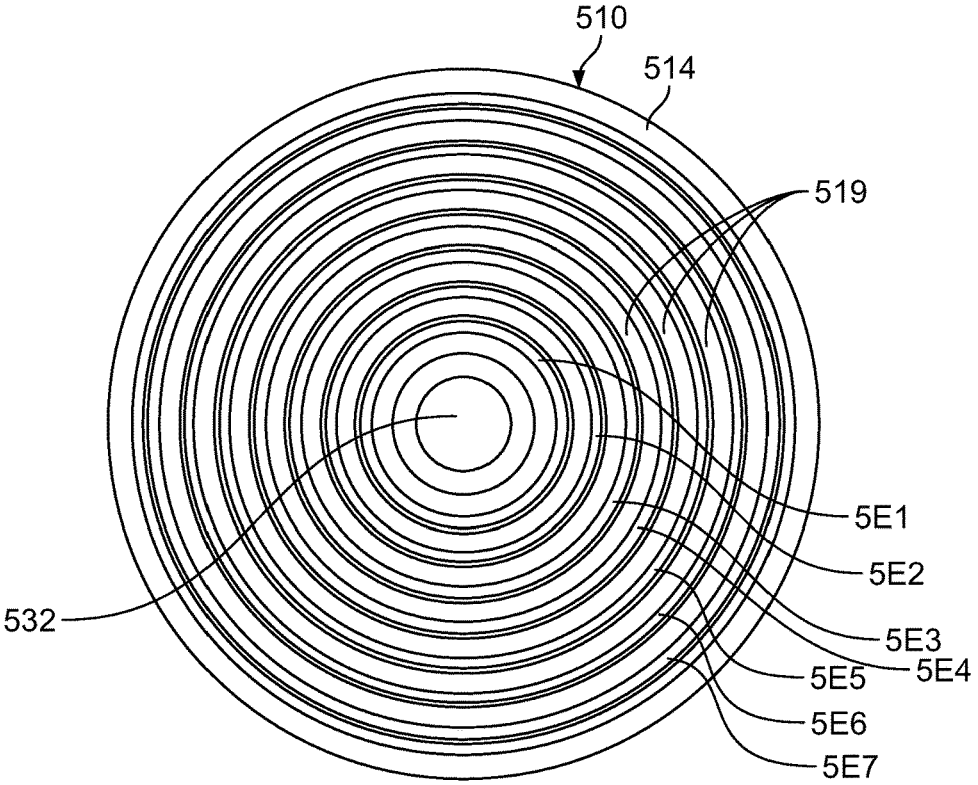
FIG. 34 is a fragmentary top plan view of the GDT of FIG. 30.
Figure 35:
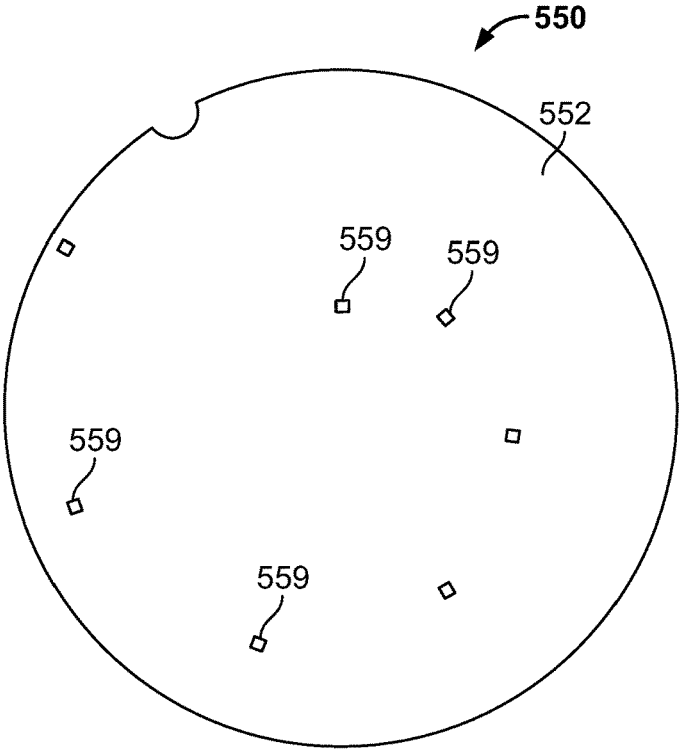
FIG. 35 is a bottom plan view of a trigger device forming a part of the GDT of FIG. 30.

To assemble the GDT 400, the inner electrodes 4E1-4E18 are seated in the slots 436B of the insulator plate 436 on one side edge and are seated in the slots 453B of the trigger device 450 on the side edge to form a cassette or subassembly 403 as shown in FIG. 27. The subsassembly 403 is inserted into the cavity 420 through the opening 424. The terminal electrodes 432 and 434 are secured and sealed by the bonding layers 437 in the openings 424. The inner electrodes 4E1-4E18 are semi-fixed or floatingly secured in the sealed chamber 404 by the locator ribs 436A, 453A and the top and bottom walls of the insulator 410.

The terminal interface layers 460 of the resistor links 4R1-4R18 are positioned on or closely adjacent the top edges of the electrodes 4E1-4E18 and 434, respectively, through the through holes 459 in the substrate 452.

The GDT 400 includes nineteen spark gaps G and nineteen cells C. In use, spark over occurs sequentially from the electrode 432, through the electrodes 4E1-4E18 and to the electrode 434. The trigger device 450 operates in the same manner as described above with regard to the trigger device 150 to control the firing sequence and timing.

With reference to FIGS. 30-35, a modular, multi-cell GDT 500 according to further embodiments of the invention is shown therein. The GDT 500 includes an insulator 510, a first terminal electrode 532, a second terminal electrode 534, a set 5E of inner electrodes 5E1-5E7, an insulator 536, a seal 538, bonding layers 537, 539, a trigger device 550, and a selected gas M corresponding to the insulator 110, the first terminal electrode 132, the second terminal electrode 134, the inner electrodes E1-E14, the insulator 136, the seals 138, the bonding layers 137, 139, the trigger device 150, and the selected gas M of the GDT 100, except as follows.

The electrodes 5E1-5E7, the trigger device 550, and the gas M are all contained in a hermetically sealed chamber 504 in a housing formed by the insulator 510 and the electrode 534. The electrode 534 serves as a cover.

The insulator 510 includes an electrode opening 524 within which the terminal electrode 532 is secured and hermetically sealed by a seal 538 and the bonding layer 537. The insulator 510 includes a series of concentric, annular steps 519. The steps 519 progressively increase in height in the direction from the terminal electrode 532 to the side wall 514. The insulator 510, the cavity 520 and the chamber 504 are tubular or cylindrically shaped.

The terminal electrode 534 includes an end wall 534A and an annular side wall 534B. The side wall 534B is secured to the side wall 514 of the insulator 510 by the bonding layer 539. The interface between the terminal electrode 534 and the side wall 514 is hermetically sealed by a seal 538 and the bonding layer 539.

The inner electrodes 5E1-5E7 are cylindrical and concentrically mounted on respective ones of the steps 519 in the chamber 504. The inner electrodes 5E1-5E7 are radially spaced apart to define annular spark gaps G and cells C therebetween. The electrodes 5E1-5E7 are radially constrained by the steps 519 and axially constrained by the insulator bottom wall 512 and the trigger device 550 so that the electrodes are semi-fixed or floating in the chamber 504. The trigger device 550 is in turn constrained by the insulator plate 536 and the terminal electrode 534.

The trigger device 550 includes a ceramic substrate 552 and resistor links 5R1-5R7 corresponding to the ceramic substrate 152 and resistor links R1-R14 of the GDT 100. The terminal interface layers 560 of the resistor links 5R1-5R7 are positioned in recesses 558 and on or closely adjacent the top edges of the electrodes 5E1-5E7 and 534, respectively, through the through holes 559 in the substrate 552. Each resistor link 5R1-5R7 includes a terminal contact 565 on its end opposite its terminal interface layer 560. The resistor links 5R1-5R7, respectively, are electrically connected to the electrode 534 via their respective terminal contacts 565. Small gaps may be present between the electrode 534 and some or all of the terminal contacts 565. According to some embodiments, the terminal contacts 565 are formed of a material as described above for the terminal interface layers 160 in order to prevent sparking and degradation of the resistor layers 564 of the resistor links 5R1-5R7 as discussed above with regard to the terminal interface layers 160 and the resistor layers 164.

The GDT 500 includes eight spark gaps G and eight cells C. In use, spark over occurs sequentially from the electrode 532, through the electrodes 5E1-5E7 and to the electrode 534. The trigger device 550 operates in the same manner as described above with regard to the trigger device 150 to control the firing sequence and timing.

Figure 36:
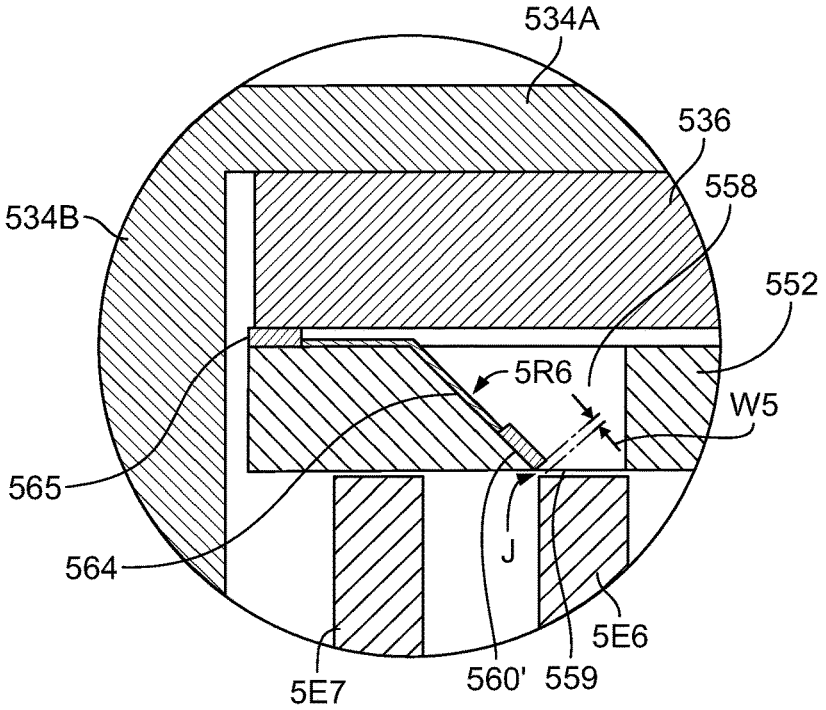
FIG. 36 is an enlarged, fragmentary view of the GDT of FIG. 30 including an alternative trigger device.

The terminal interface layers 560 may be masses or plugs of the electrically conductive material that substantially fill the holes 559 as shown and described above with regard to the terminal interface layers 160 and with reference to FIG. 7. According to further embodiments and as shown in FIG. 36, the terminal interface layers 560 may take the form of relatively thin layers 560' and the through holes 559 may remain open. The terminal interface layers 160, 260, 360, 460 may likewise be formed in this manner. A gap J may be present between each or some of the terminal interface layers 560' and their respective electrodes 5E1-5E7. According to some embodiments, each of the gaps J has a width W5 of less than about 0.5 mm.

Figure 37:
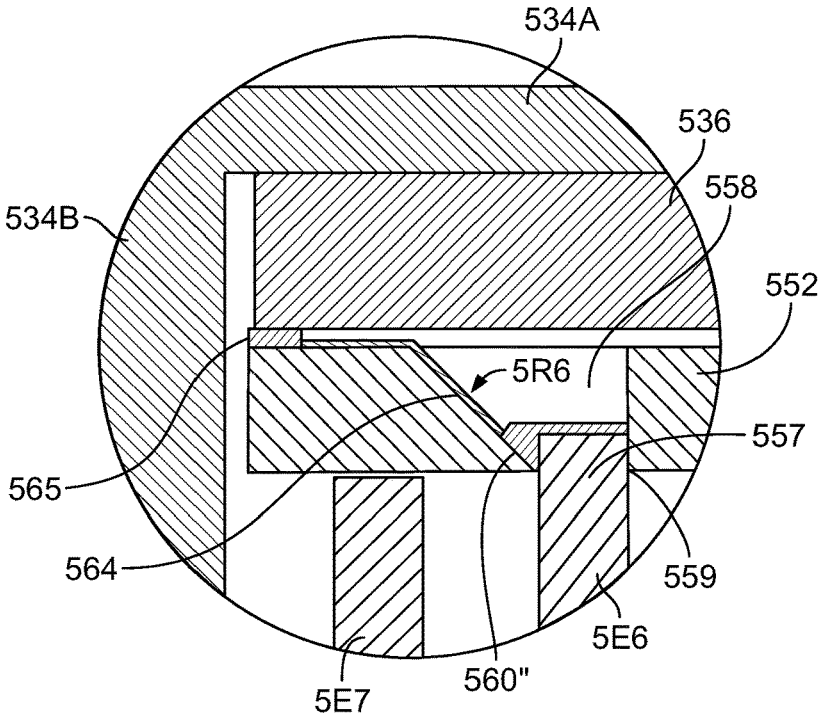
FIG. 37 is an enlarged, fragmentary view of the GDT of FIG. 30 including a further alternative trigger device.

According to further embodiments and with reference to FIG. 37, each electrode 5E1-5E7 may include an integral contact protrusion or pin 557 projecting upwardly from its top edge. The pin 557 is received in a respective through hole 559 and extends into the associated recess 558. In this embodiment, each terminal interface layer 560 takes the form of a terminal interface layer 560" that fills the space about the pin 557 in the recess 558. Each terminal interface layer 560" is bonded to its corresponding resistor layer 564 to the ceramic 552 and to the pin 557 to effect electrical and mechanical connection therebetween. Thus, in this embodiment, the gaps between each terminal interface layer 560 and its electrode may be eliminated. The terminal interface layers 160, 260, 360, 460 may likewise be formed in this manner. This embodiment may be manufactured by installing the pins 557 in the through holes 559, and then placing the material of the terminal interface layers 560" in the recesses 558 in molten or liquid form, after which the material solidifies (e.g., by drying or cooling) or heating (sintering) and bonds to the resistor layer, ceramic and pin.

Figure 38:
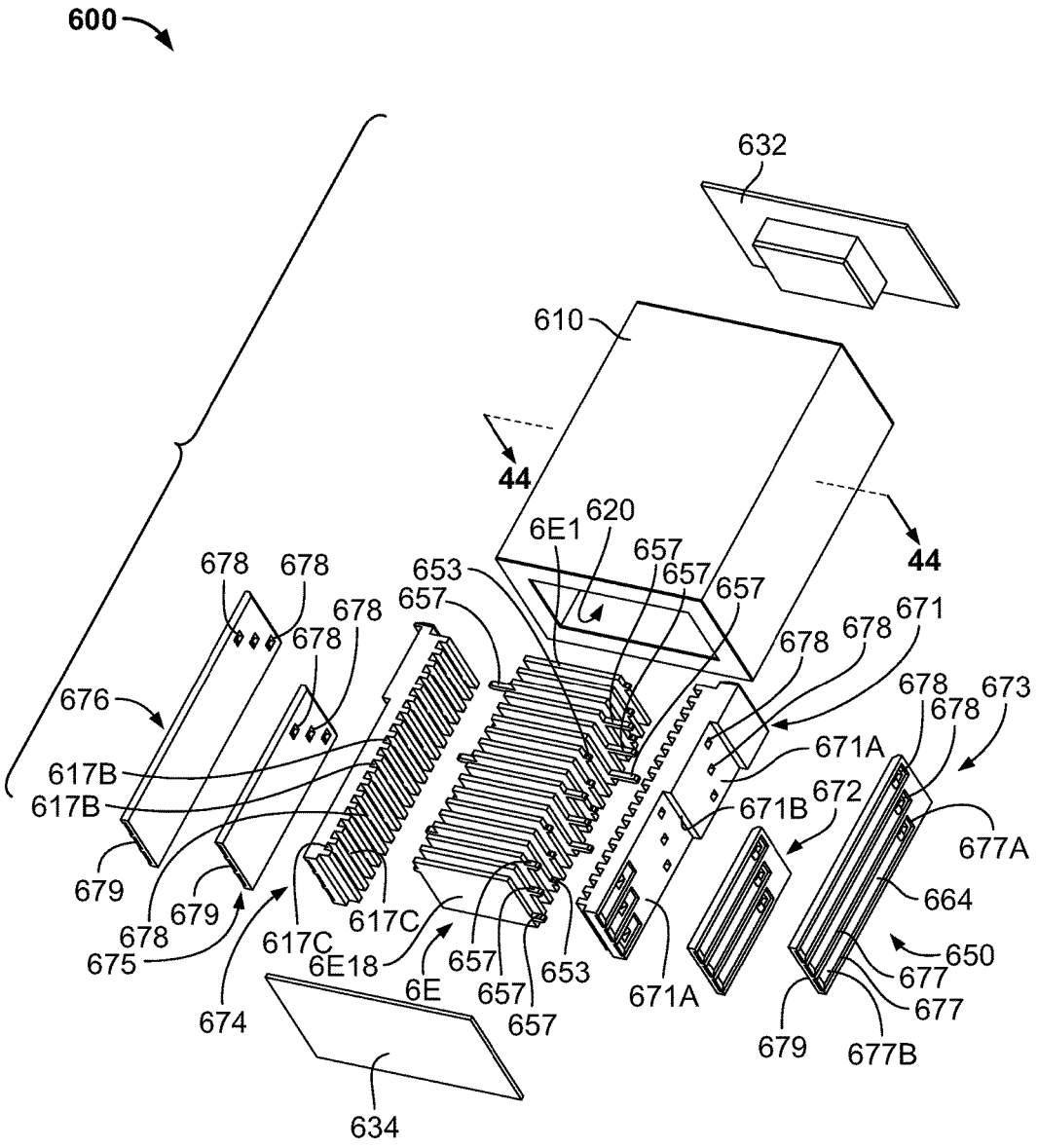
FIGS. 38 and 39 are exploded, perspective views of a gas discharge tube (GDT) according to further embodiments of the invention.
Figure 39:
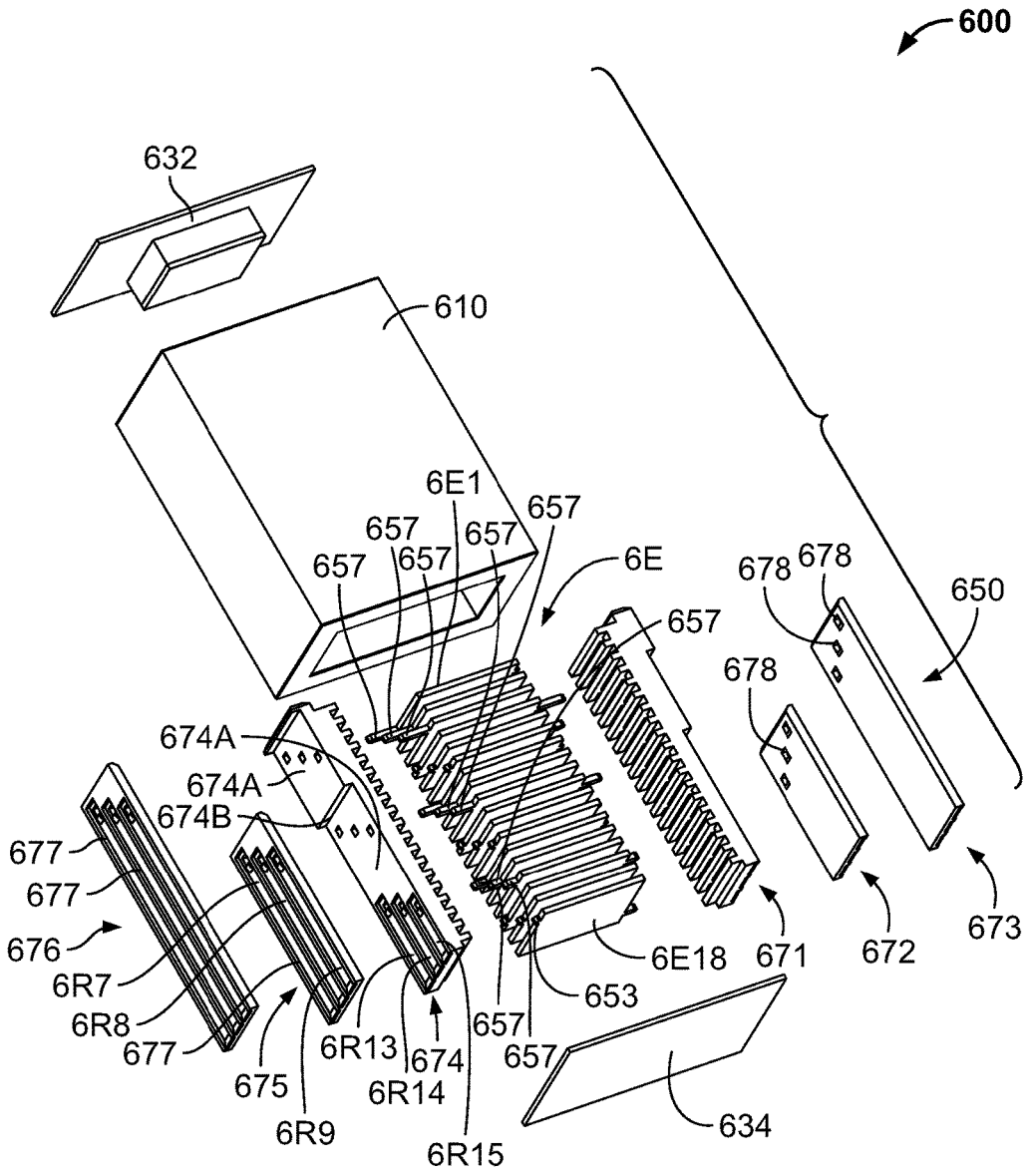

With reference to FIGS. 38-44, a modular multi-cell GDT 600 according to further embodiments of the invention is shown therein. While FIGS. 38 and 39 are exploded views, the GDT 600 will outwardly appear substantially the same as the GDT 400 when assembled. The GDT 600 includes an insulator 610, a first terminal electrode 632, a second terminal electrode 634, a set 6E of inner electrodes 6E1-6E18 (FIG. 40), bonding layers (not labeled), seals (not labeled), and a selected gas (not labeled) corresponding to the insulator 410, the first terminal electrode 432, the second terminal electrode 434, the set 4E of inner electrodes 4E1-4E18, the bonding layers 437, the seals 438, and the gas M of the GDT 400, except as discussed below. The GDT 600 further includes a multi-layered trigger device 650 corresponding to the trigger device 450. The trigger device 650 performs the same function as the trigger device 450 in generally the same manner, but is differently constructed in order to provide improved and/or more consistent and reliable performance.

The inner electrodes 6E1-6E18 each include relatively short integral locator pins 653 (FIGS. 38 and 39) projecting from one side edge, and relatively long integral electrical contact pins 657 projecting from their opposed side edges. The contact pins 657 have different lengths and are staggered in height along the electrode side edges.

The trigger device 650 includes six discrete substrates 671, 672, 673, 674, 675, and 676. The substrates 671-676 may be formed in substantially the same manner and of the same material as the substrate 452.

Each of the substrates 671-676 includes three longitudinally extending grooves 677 extending along a lengthwise axis I-I (FIG. 44) from a proximal end 677A to an opposing distal end 677B (FIG. 38). The distal ends 677B each terminate proximate, at or closely adjacent a distal end 679 of the substrate 671-676. Laterally extending through holes 678 extend fully through the thicknesses of the substrates 671-676. The through holes 678 are axially staggered. One of the holes 678 terminates proximate the proximal end 677A of each groove 677.

The substrates 671 and 674 each include slots 617B corresponding to slots 417B to receive and to secure the inner electrodes 6E1-6E18. The substrates 671, 674 also include locator recesses 617C to receive the locator pins 653 to locate the electrodes 6E1-6E18 along the height axis. The substrate 671 includes axially distributed recesses 671A with a step 671B therebetween. The substrate 674 includes recesses 674A with a step 674B therebetween.

A respective resistor link 6R1-6R18 (FIGS. 39-42) is located in each groove 677. Each resistor link 6R1-6R18 includes a resistor layer 664 corresponding to the resistor layers 464, and terminal interface layers 660A, 660B corresponding to the terminal interface layers 460. The interface layers 660A are located at the through holes 678. The interface layers 660B are located at the distal ends 679. The trigger device 650 does not include a conductive link corresponding to the connecting layer 462.

The second terminal electrode 634 (FIG. 44) includes an outer contact section 634A, a trigger contact section 634B, and an electrode gap surface 634C.

Figure 40:
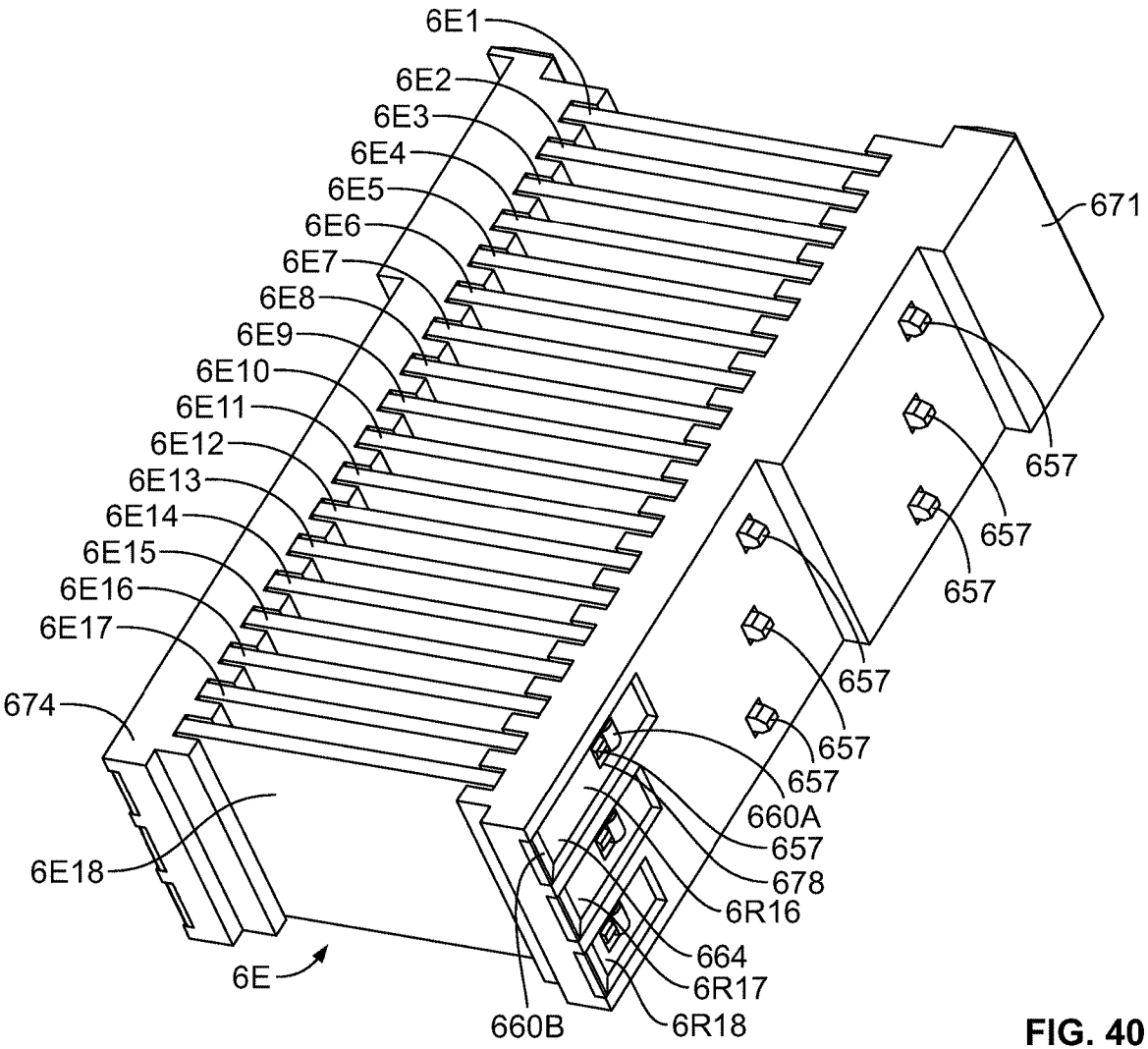
FIGS. 40-43 are perspective views illustrating a method of assembling the GDT of FIG. 38.

The GDT 600 may be assembled in the same manner as the GDT 400, except as follows. The substrates 671 and 674 are mounted on either side of the set 6E of electrodes as shown in FIG. 40. The edge portions of the electrodes 6E1-6E18 are received in the slots 617B of the substrates 671, 674 and the electrodes 6E1-6E18 are thereby captured between the substrates 671, 674. The locator pins 653 are seated in the locator recesses 617C. The contact pins 657 project through the holes 678. On one side, the three distal most contact pins 657 extend into the holes 678 the resistor links 6R16-6R18 of the substrate 671 such that they make contact with or are positioned closely adjacent to the interface layers 660A of the resistor links 6R16-6R18. On the other side, the distalmost contact pins 657 extend into the holes 678 of the resistor links 6R13-6R15 of the substrate 674 such that they make contact with or are positioned closely adjacent the interface layers 660A of the resistor links 6R13-6R15.

Figure 41:
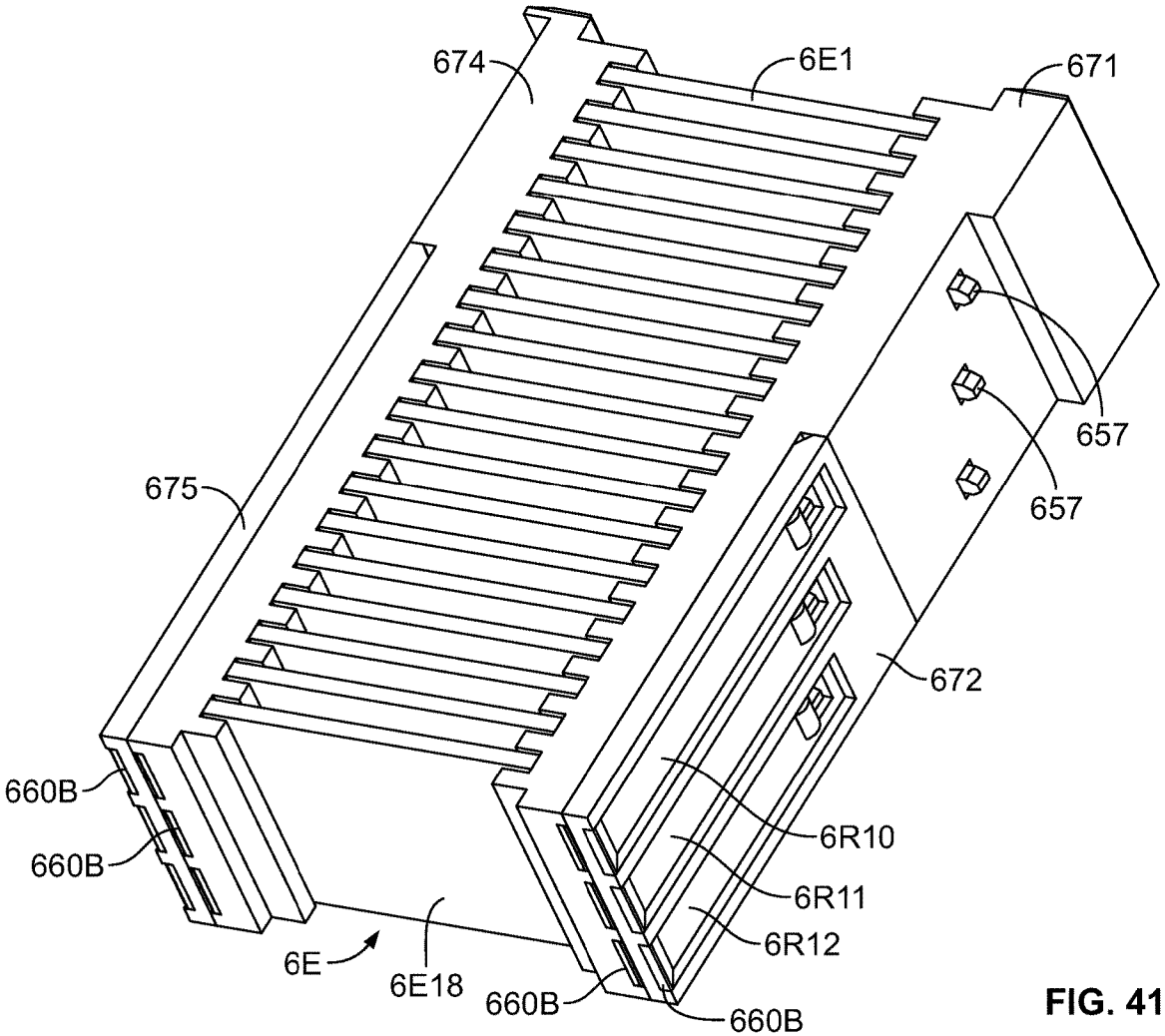

With reference to FIG. 41, the substrate 672 is mounted in the lower recess 671A of the substrate 671 such that the middle three contact pins 657 on that side extend through the holes 678 in the substrate 672. These contact pins 657 make contact with or are located closely adjacent the interface layers 660A of the resistor links 6R10-6R12. Similarly, the substrate 675 is mounted in the lower recess 674A of the substrate 674 such that the middle three contact pins 657 on that side extend through the holes 678 in the substrate 675. These contact pins 657 make contact with or are located closely adjacent to the interface layers 660A of the resistor links 6R7-6R9.

Figure 42:
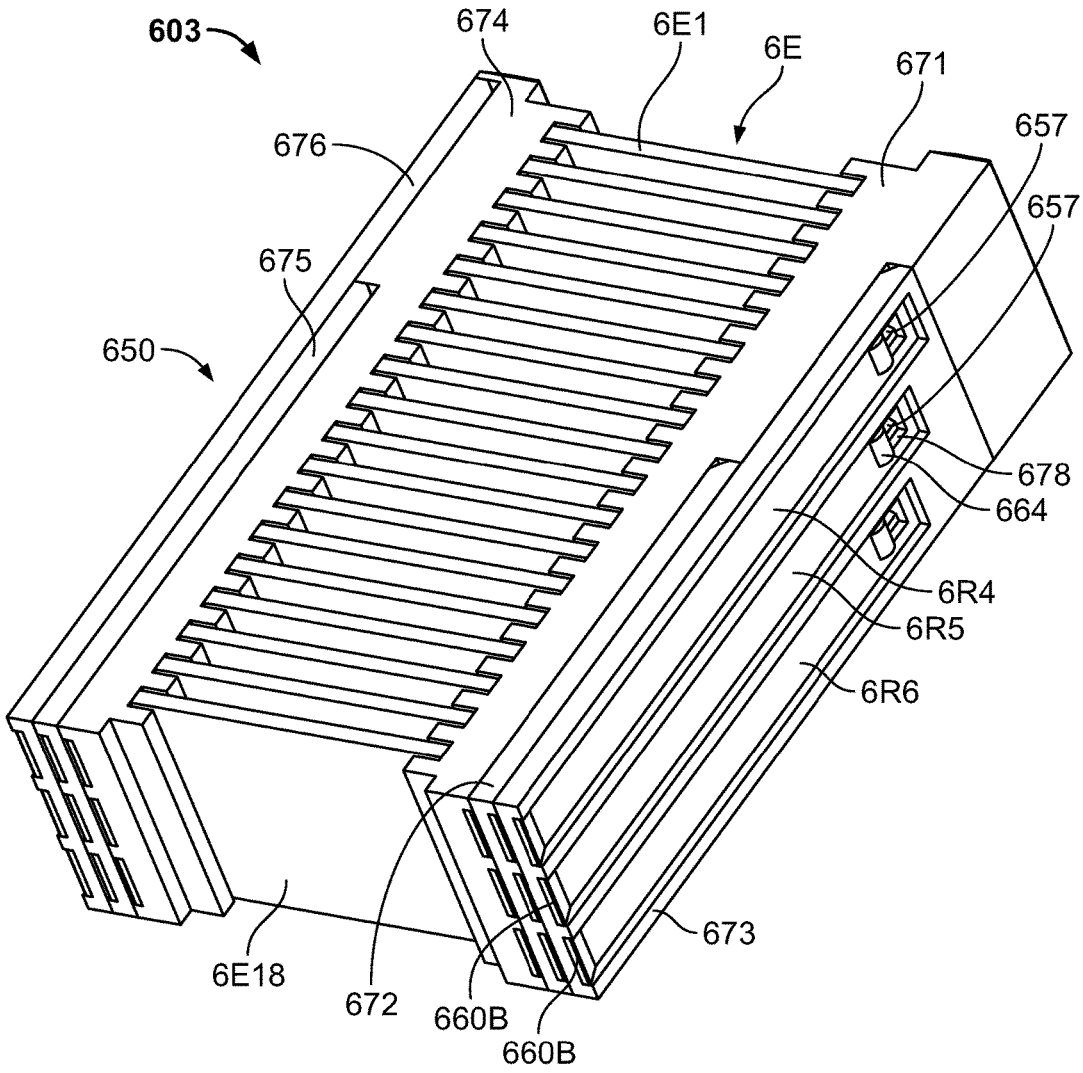
Figure 43:
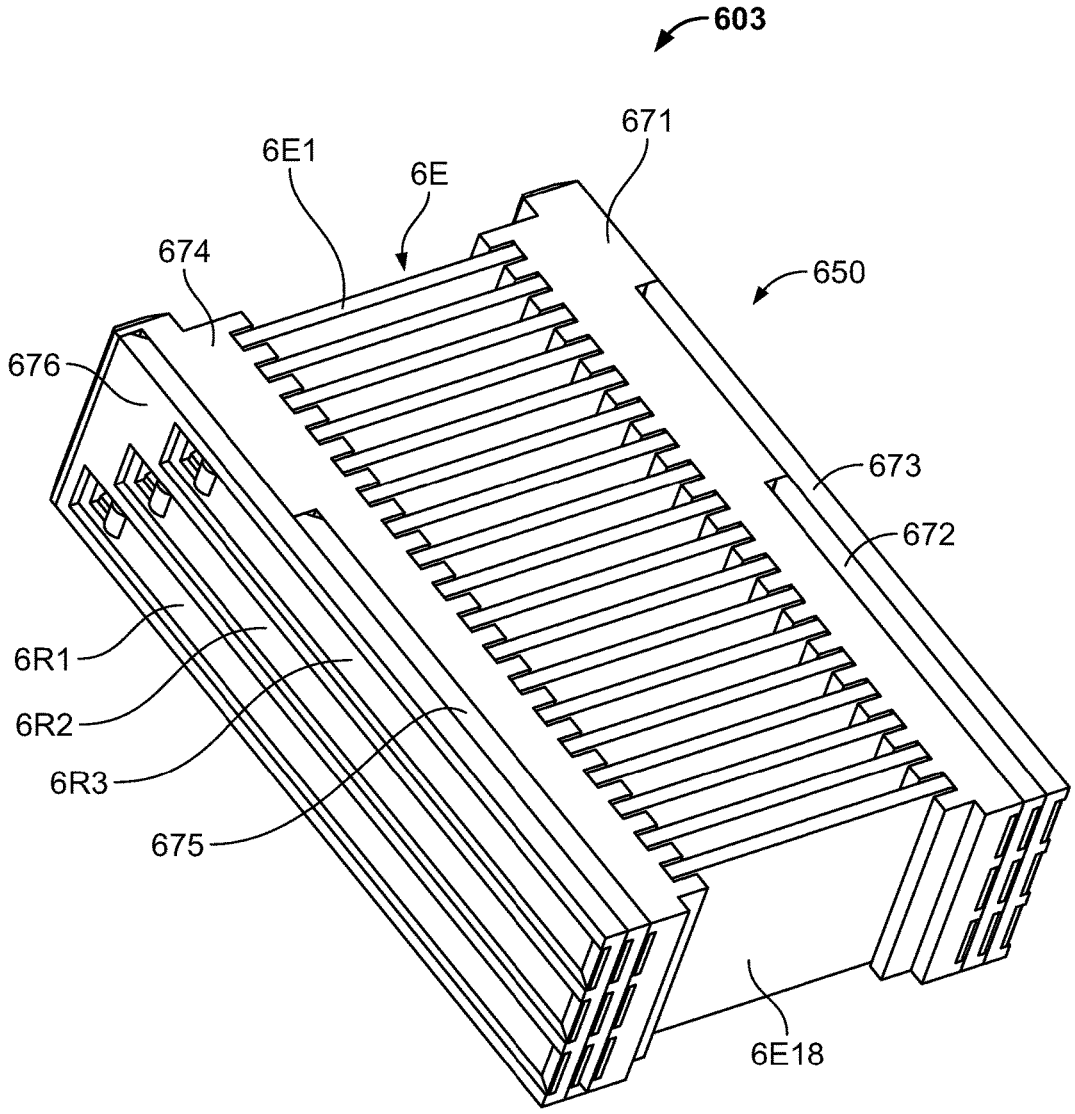

With reference FIG. 42, the substrate 673 is mounted over the substrate 672 and in the upper recess 671A of the substrate 671. The three proximal contact pins 657 extends through the through holes 628 and the substrate 673 and make contact with or are positioned closely adjacent the interface layers 660A of the resistor links 6R4-6R6. Similarly, the substrate 676 is mounted over the substrate 675 and in the upper recess 674A of the substrate 674. The three proximal contact pins 657 extend through the holes 678 in the substrate 676 and make contact with or are positioned closely adjacent to the interface layers 660A of the resistor links 6R1-6R3. A subassembly 603 as shown in FIGS. 42 and 43 is thus formed.

Figure 44:
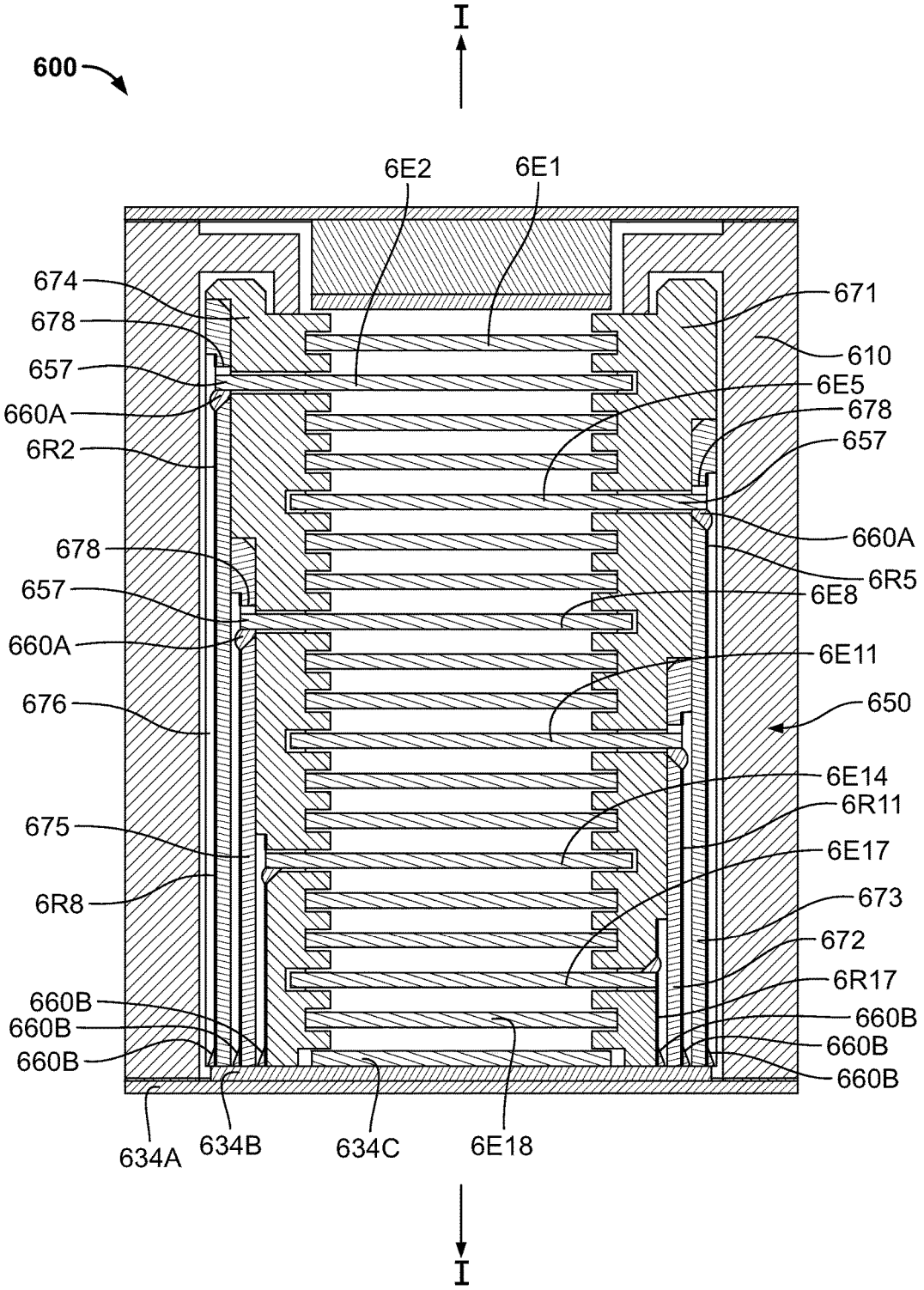
FIG. 44 is a cross-sectional view of the GDT of FIG. 38 taken along the line 44-44 of FIG. 38.

The subassembly 603 is inserted in the passage 620 of the housing 610. The terminal electrodes 632, 634 are secured to the housing 610 on either end. As best as seen in FIG. 44, the substrate distal ends 679 are located adjacent the terminal electrode section 634A so that the distal interface layers 660B are located in contact with or closely adjacent the section 634A. The terminal electrode section 634C is positioned at a prescribed distance from the inner electrode 6E18 define a gap G.

In this manner, each of the inner electrodes 6E1-6E18 is electrically connected directly to the terminal electrode 634 through its respective contact pin 657 and its respective resistor link 6R1-6R18.

The resistor links 6R1-6R18 (and, in particular, the resistor layers 664 thereof) are relatively layered so that the resistor links of each substrate 671-676 lie in different longitudinally and heightwise extending planes, which planes are laterally spaced apart. The substrates 671-676 electrically insulate the resistor links 6R1-6R18 from one another.

The multi-layered trigger device 650 can provide certain advantages. The resistor layers 664 of each of the resistor links 6R1-6R18 can be formed of sufficient length to reliably provide electrical resistance that is sufficiently high and stable for the intended operation. Also, by eliminating the connecting layer 462, the risk of unintended electrical resistance in that layer (e.g., caused by damage in use) can be eliminated. Thus, the trigger device 650 can be constructed to have robust electrical performance while also permitting the compact form factor and other advantages (e.g., in manufacture) of the rectangular GDT configuration.

It has been found that, when the gas M includes helium gas in a significant proportion, the arc voltage between adjacent electrodes is significantly increased as compared to when other commonly used gases are used, while maintaining substantially the same or a similar overall protection level voltage for the GDT device. As a result, the GDT can be constructed with fewer inner electrodes and cells, which permits the GDT to be formed with a smaller size and fewer parts in the GDT. As described above, in some embodiments, the gas M includes helium in an amount at least 50% by volume of the total volume of gas present in the GDT chamber (e.g., the chamber 104, 204, 304, 404, 504, or the chamber of the GDT 600). As discussed above, in some embodiments, a GDT containing a gas M including helium as described is electrically connected between a line or phase voltage of a single or multi-phase power system or circuit and a neutral line of the single or multi-phase power system or circuit.

Moreover, a gas medium including helium gas may be used in each one of a group or set of serially electrically connected single-cell GDTs (e.g., of otherwise known design) that are arranged to provide an overvoltage protection circuit. In this case, each single-cell GDT may include its own respective housing defining its own individual sealed GDT chamber, and the helium-containing gas mediums are present in each GDT chamber between the electrodes of the respective GDT (i.e., the gas is not shared between fluidly communicating cells as in the multi-cell GDTs described herein). The overvoltage protection circuit may include an external trigger device operative to serially trigger the cells of the linked single-cell GDTs. In some embodiments, an overvoltage protection circuit including helium-containing gases as described is electrically connected between a line or phase voltage of a single or multi-phase power system or circuit and a neutral line of the single or multi-phase power system or circuit.

According to some embodiments, the terminal interface layers (e.g., layers 160, 260, 360, 460, 560, 560', 560", 660A, 660B) and the connecting layers (e.g., layer 162) are initially provided as metal compound including a metal powder in a liquid phase carrier. The compound is applied to the substrate (e.g., substrate 152) and then dries and becomes solid to form the respective terminal interface layer or connecting layer bonded to the substrate and resistor layer. According to some embodiments, the liquid phase carrier is liquid sodium silicate in liquid phase.

While the GDTs 100-600 have been shown and described herein having certain numbers of inner electrodes (e.g., electrodes E1-E14), GDTs according to embodiments of the invention may have more or fewer inner electrodes. According to some embodiments, a GDT as disclosed herein has at least two inner electrodes defining at least three spark gaps G and, in some embodiments, or at least three inner electrodes defining at least four spark gaps G.

According to further embodiments, the terminal electrodes and the inner electrodes may have different shapes than those shown in the figures. In some embodiments, the inner electrodes E1, E14, 2E1, 2E19 nearest the terminal electrodes 132, 134, 232, 234 are annular or cylindrical. This configuration can enlarge the active area of the inner electrodes to conduct current from the terminal electrodes.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed is:

1. A gas discharge tube comprising:
a housing defining a chamber;
first and second terminal electrodes mounted on the housing;
a plurality of inner electrodes located in the chamber;
a gas contained in the chamber;
wherein the inner electrodes are serially disposed in the chamber in spaced apart relation to define a series of spark gaps from the first terminal electrode to the second terminal electrode;
wherein the chamber is hermetically sealed; and
wherein:
the gas discharge tube includes a trigger device that is electrically conductively coupled to the first terminal electrode or the second terminal electrode and to ones of the plurality of inner electrodes;
the trigger device is disposed in the chamber; and
the trigger device includes a plurality of resistor links configured to conduct current from the inner electrodes.

2. The gas discharge tube of claim 1 wherein the plurality of inner electrodes includes at least three electrodes defining at least four spark gaps.

3. The gas discharge tube of claim 1 wherein the housing includes an insulator and a cover forming the housing and defining the chamber, and the insulator is formed of an electrically insulating material.

4. The gas discharge tube of claim 3 wherein the cover is electrically conductive.

5. The gas discharge tube of claim 1 wherein at least some of the inner electrodes are curved plates.

6. The gas discharge tube of claim 1 wherein the inner electrodes are captured in the chamber such that relative displacement is permitted between the housing and the inner electrodes.

7. The gas discharge tube of claim 1 wherein:
the trigger device includes a substrate formed of an electrically insulating material and mounted in the housing; and
the resistor links are mounted on the substrate.

8. The gas discharge tube of claim 7 wherein the trigger device includes holes defined in the substrate to permit electrical connection between the resistor links and the inner electrodes.

9. The gas discharge tube of claim 7 wherein each of the resistor links includes a resistor layer bonded to the substrate, the resistor layer being formed of an electrically resistive material.

10. The gas discharge tube of claim 9 wherein the electrically resistive material includes graphite in an adhesive carrier.

11. The gas discharge tube of claim 9 wherein:

each of the resistor links further includes a terminal interface layer between the resistor layer thereof and the inner electrode associated with the resistor link; and each terminal interface layer is formed of metal.

12. The gas discharge tube of claim 7 wherein each of the resistor links has a resistance value in the range of from about 3 to 500 ohm.

13. The gas discharge tube of claim 7 wherein the trigger device includes integral locator features that secure the inner electrodes in position in the chamber.

14. The gas discharge tube of claim 7 wherein the trigger device includes:

first and second substrates each formed of an electrically insulating material;

at least one resistor link mounted on the first substrate; and at least one resistor link mounted on the second substrate;

wherein the resistor links are configured to conduct current from the inner electrodes.

15. The gas discharge tube of claim 14 wherein the second substrate is stacked on the first substrate.

16. The gas discharge tube of claim 1 wherein the housing includes integral locator features that secure the inner electrodes in position in the chamber.

17. The gas discharge tube of claim 1 wherein:

the housing includes a partition wall that divides the chamber into fluidly connected first and second subchambers;

the first terminal electrode is disposed in the first subchamber;

the second terminal electrode is disposed in the second subchamber; and some of the inner electrodes are disposed in the first subchamber and some of the inner electrodes are disposed in the second subchamber.

18. The gas discharge tube of claim 1 wherein:

the inner electrodes are concentric, cylindrically-shaped plates; and the second terminal includes an annular wall concentric with and circumferentially surrounding the inner electrodes.

19. The gas discharge tube of claim 1, wherein the gas contained in the chamber comprises helium.

20. The gas discharge tube of claim 19, wherein the helium gas is present in the chamber in an amount of at least 50% by volume of the total volume of gas in the chamber.

21. The gas discharge tube of claim 19, wherein the gas contained in the chamber comprises a mixture of helium and at least one other gas.

22. The gas discharge tube of claim 9 wherein the resistor links each have a different length.

23. The gas discharge tube of claim 11 wherein the inner electrodes are captured in the chamber such that relative displacement is permitted between the housing and the inner electrodes.

24. The gas discharge tube of claim 1 wherein each resistor link is configured to conduct current from a respective one of the inner electrodes to the second terminal electrode to thereby induce a spark across a respective one of the spark gaps preceding the respective one of the inner electrodes.

25. A gas discharge tube comprising:

a housing defining a chamber;

first and second terminal electrodes mounted on the housing;

a plurality of inner electrodes located in the chamber;

a gas contained in the chamber;

wherein the inner electrodes are serially disposed in the chamber in spaced apart relation to define a series of spark gaps from the first terminal electrode to the second terminal electrode;

wherein the chamber is hermetically sealed; and wherein:

the gas discharge tube includes a trigger device that is electrically conductively coupled to the first terminal electrode or the second terminal electrode and to ones of the plurality of inner electrodes;

the trigger device is disposed in the housing;

the trigger device includes a plurality of resistor links configured to conduct current from the inner electrodes;

the inner electrodes are captured in the chamber such that relative displacement is permitted between the resistor links and the inner electrodes;

each of the resistor links further includes a terminal interface layer between the resistor layer thereof and the inner electrode associated with the resistor link; and each terminal interface layer is formed of metal.

26. The gas discharge tube of claim 25 wherein the trigger device includes integral locator features that capture the inner electrodes in the chamber such that relative displacement is permitted between the resistor links and the inner electrodes.

27. The gas discharge tube of claim 25 wherein:

the trigger device includes a substrate formed of an electrically insulating material and mounted in the housing; and the resistor links are mounted on the substrate.

28. The gas discharge tube of claim 27 wherein the trigger device includes holes defined in the substrate to permit electrical connection between the terminal interface layers and the inner electrodes.

29. The gas discharge tube of claim 27 wherein each of the resistor links includes a resistor layer bonded to the substrate, the resistor layer being formed of an electrically resistive material.

30. The gas discharge tube of claim 29 wherein the electrically resistive material includes graphite in an adhesive carrier.

31. A gas discharge tube comprising:

a housing defining a chamber;

first and second terminal electrodes mounted on the housing;

a plurality of inner electrodes located in the chamber;

a gas contained in the chamber;

wherein the inner electrodes are serially disposed in the chamber in spaced apart relation to define a series of spark gaps from the first terminal electrode to the second terminal electrode;

wherein the chamber is hermetically sealed; and wherein:

the inner electrodes are concentric, cylindrically-shaped plates; and the second terminal includes an annular wall concentric with and circumferentially surrounding the inner electrodes.

* * * * *